US010105980B1

(12) United States Patent
Hojo

(10) Patent No.: US 10,105,980 B1
(45) Date of Patent: Oct. 23, 2018

(54) PRINTING APPARATUS, MAIN BODY OF PRINTING APPARATUS AND CASSETTE

(71) Applicant: Brother Kogyo Kabushiki Kaisha, Nagoya-shi, Aichi-ken (JP)

(72) Inventor: Kazuma Hojo, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,711

(22) Filed: Sep. 27, 2017

(30) Foreign Application Priority Data

Mar. 31, 2017 (JP) ..... 2017-072802
May 31, 2017 (JP) ..... 2017-107284

(51) Int. Cl.
*B41J 35/08* (2006.01)
*B41J 2/325* (2006.01)
*B41J 32/00* (2006.01)

(52) U.S. Cl.
CPC ..... *B41J 35/08* (2013.01); *B41J 2/325* (2013.01); *B41J 32/00* (2013.01)

(58) Field of Classification Search
CPC ... B41J 35/08; B41J 17/30; B41J 17/32; B41J 33/34; B41J 33/16; B41J 2/325; B41J 33/14
See application file for complete search history.

(56) References Cited

U.S. PATENT DOCUMENTS 8,665,301 B2 * 3/2014 Starkey ..... B41J 33/16 347/217
9,120,345 B2 9/2015 Kim et al.
2009/0003915 A1 1/2009 Kobayashi et al.
2011/0299907 A1 12/2011 Kim et al.
2013/0113870 A1 5/2013 Starkey et al.
2014/0212196 A1 7/2014 Deonarine

FOREIGN PATENT DOCUMENTS

EP 2392465 A2 12/2011
GB 2482167 A 1/2012
JP 2013-537508 A 10/2013

OTHER PUBLICATIONS

Mar. 16, 2018—(EP) Extended Search Report—App 17193814.5.

* cited by examiner

*Primary Examiner* — Huan Tran
(74) *Attorney, Agent, or Firm* — Banner & Witcoff, Ltd.

(57) ABSTRACT

There is provided a printing apparatus which includes a base, a movable member which is movably held by the base, to be movable along a first direction which is parallel to the base, a spring which applies a bias to the movable member, at one side in the first direction, a bearing which is supported by the movable member, a roller which is rotatably supported by the bearing, and is extended in a second direction orthogonal to the base, and which guides the ink ribbon, a first detection target member which is provided to the roller, to be rotatable integrally with the roller, and a first sensor which is provided to the movable member, and is facing the first detection target member, and which detects rotation of the first detection target member.

20 Claims, 22 Drawing Sheets

UP
DOWN
FRONT
REAR
SE1
205
200b
200a
200
201
47L
121
r
117R
120
117F
116i
116o
118
113R
114
112
115a
115b
115c
115
L
200c
200x
203x
202
203
43
112A
114
112
100
113F
131
131y
32y
32
131x
133x
133
132

PRINTING APPARATUS, MAIN BODY OF PRINTING APPARATUS AND CASSETTE

CROSS REFERENCE TO RELATED APPLICATION

The present application claims priority from Japanese Patent Applications No. 2017-072802 filed on Mar. 31, 2017 and No. 2017-107284 filed on May 31, 2017, the disclosure of which is incorporated herein by reference in its entirety.

BACKGROUND

Field of the Invention

The present disclosure relates to a printing apparatus which carries out printing by transferring an ink of an ink ribbon, and a main body of a printing apparatus and a cassette used in a printing apparatus.

Description of the Related Art

For instance, there is known a printing apparatus (tape apparatus) which carries out printing by transferring an ink by heating an ink ribbon (printer ink ribbon). In this known printing apparatus, a thermosensitive ink ribbon is wound on a spool, and a ribbon feeding roll is formed. An ink ribbon drawn (unreeled) from this ribbon feeding roll is transported, and the ink is transferred from the ink ribbon that is transported, by a thermal head (print head) provided to a transportation path being heated. The ink ribbon after the transfer is wound to another spool, and a ribbon take-up roll (ribbon wind-up roll) is formed.

In the known printing apparatus, a tension adjusting unit which adjusts a tension in the ink ribbon is provided to one of the sides in a transporting direction of a printing head, and a sensor assembly which detects an amount transported of the ink ribbon is provided to the other side in the transporting direction of the printing head. The tension adjusting unit is provided with a roller (tension adjusting roller) provided to the transportation path of the ink ribbon, a recess portion which is formed in a base plate (plate) for making the tension adjustment roller undergo reciprocating motion, a spring (an extension spring) for applying a constant force to the tension adjusting roller, and a position sensor which detects the reciprocating motion of the tension adjusting roller. The sensor assembly is provided with a roller (first roller) which is provided to the transportation path of the ink ribbon, and a rotation sensor (sensor) which measures an amount of rotation of the first roller.

SUMMARY

To achieve the object, a printing apparatus according to the present disclosure includes: a base; a movable member held by the base movably along a first direction parallel to the base; a spring configured to apply a bias to the movable member, toward one side in the first direction; a bearing supported by the movable member; a roller rotatably supported by the bearing, the roller extending in a second direction orthogonal to the base; a first detection target member fixed to the roller; and a first sensor provided to the movable member, and configured to face the first detection target member.

DETAILED DESCRIPTION OF THE EMBODIMENTS

In the known printing apparatus, since the tension adjusting unit and the sensor assembly have been provided separately as described above, a wide installation space is necessary, and it becomes difficult to make the apparatus small-sized. If it is possible to integrate the tension adjusting unit and the sensor assembly, it should be possible to facilitate reduction in the installation space, and small-sizing.

Here, in a case of facilitating integration by combining the tension adjusting unit and the sensor assembly in the known printing apparatus, the rotation sensor which measures the amount of rotation is to be arranged for the tension adjusting roller of the tension adjusting unit. However, in this case, as the tension adjusting roller moves (undergoes reciprocating movement) in the recess portion of the base plate as heretofore described, it is not possible to detect the amount of rotation of the roller by the rotation sensor in a state as it has been.

An object of the present disclosure is, for example, to provide a printing apparatus in which it is possible to carry out detection of transportation amount of the ink ribbon, and adjustment of tension in the ink ribbon by one common roller, and a printing apparatus main body and a cassette used in the printing apparatus.

An embodiment of the present disclosure will be described below while referring to the accompanying diagrams. In the following description, a vertical direction, a front-rear direction, and a left-right direction correspond to directions of arrows depicted in each diagram such as FIG. 1.

<Overall Structure of Printing Apparatus>

Figure 1:
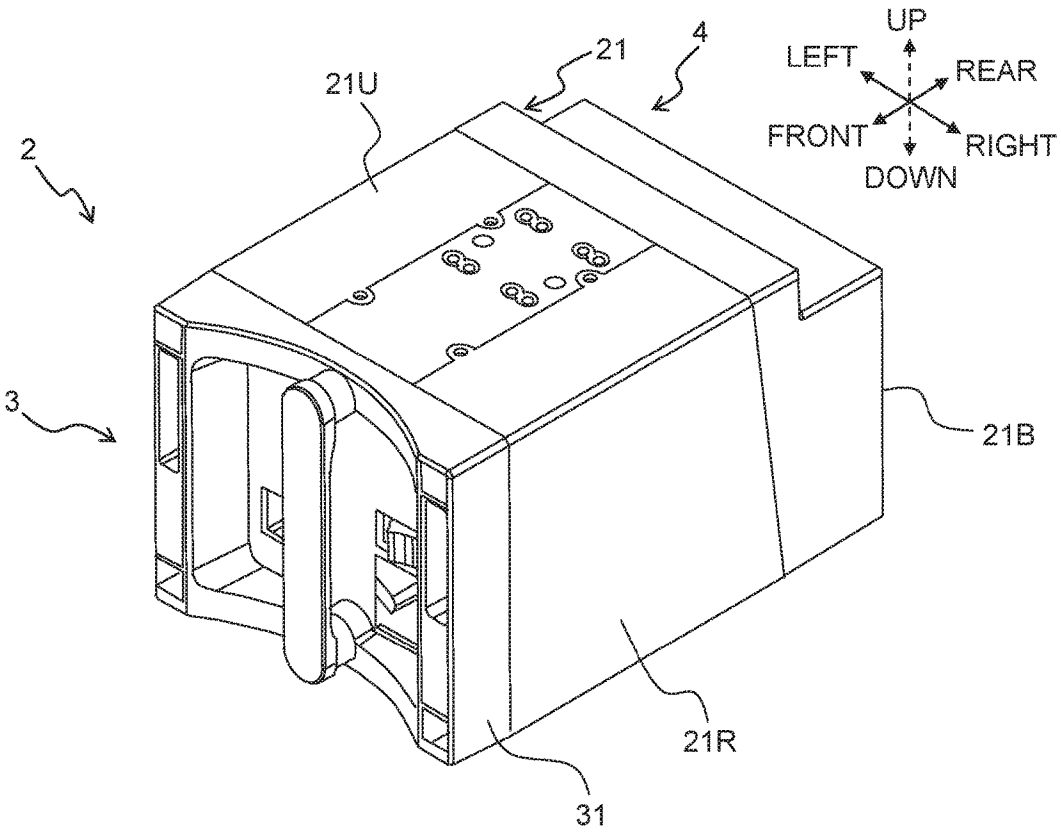
FIG. 1 is a perspective view seen from an obliquely upper side showing an appearance of a printing apparatus according to an embodiment of the present disclosure.
Figure 2:
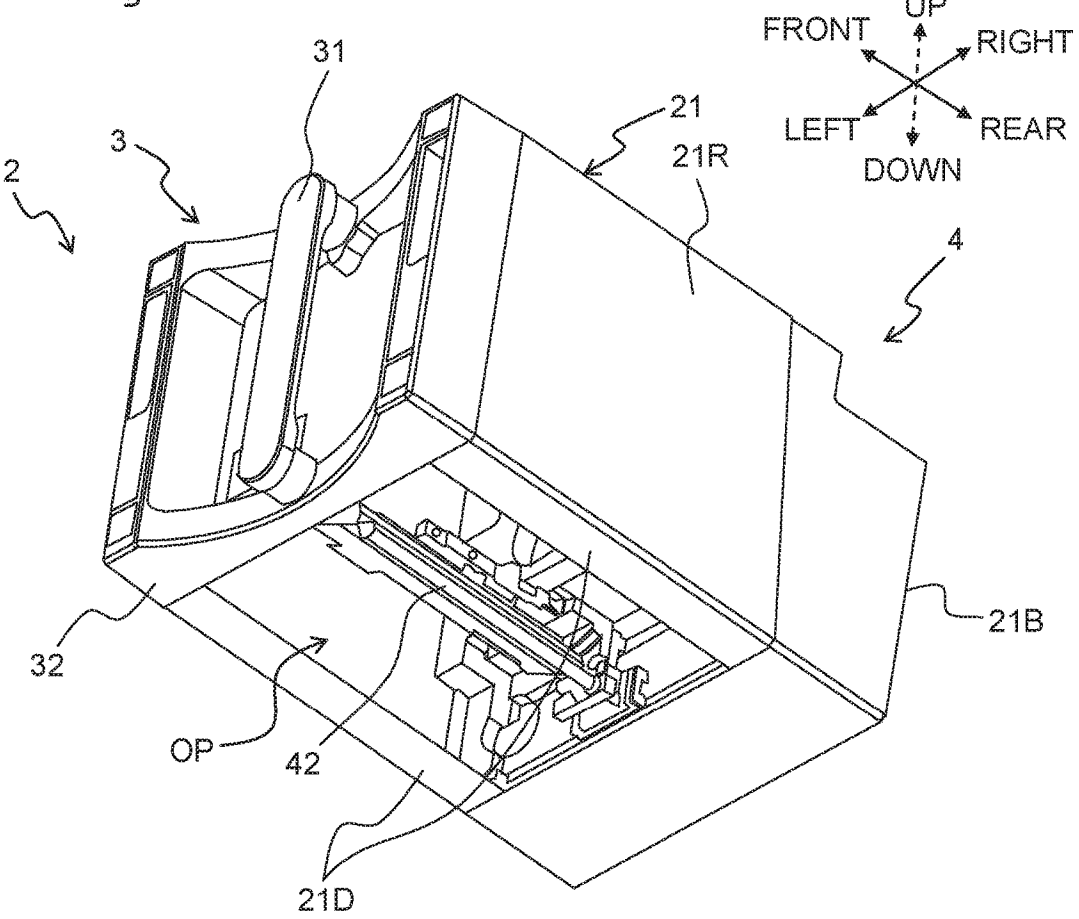
FIG. 2 is a perspective view seen from an obliquely lower side showing an appearance of the printing apparatus.

In FIG. 1 and FIG. 2, a printing apparatus 2 includes a printing apparatus main body 4 having a casing (housing) 21, and a cassette 3 which is detachably arranged in a horizontal direction with respect to the casing 21. In this example, the horizontal direction corresponds to the front-rear direction <Arrangement of Cassette 3>

Figure 3:
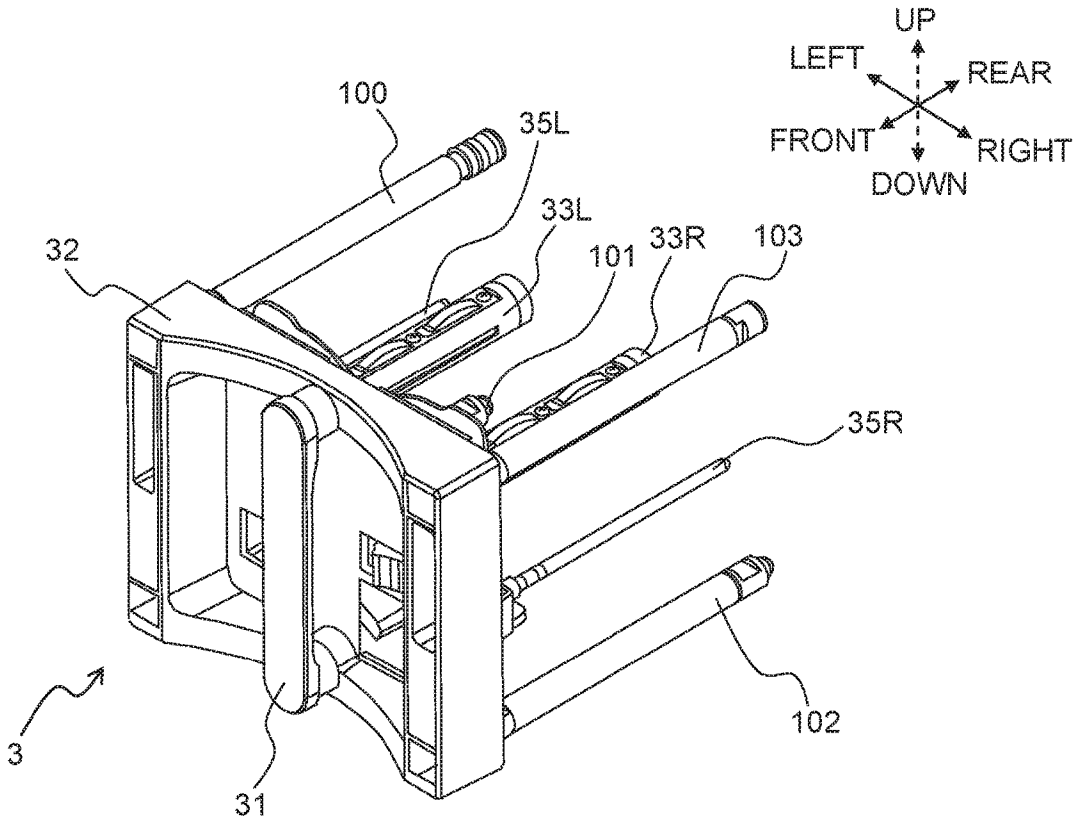
FIG. 3 is a perspective view showing an overall structure of a cassette.
Figure 4B:
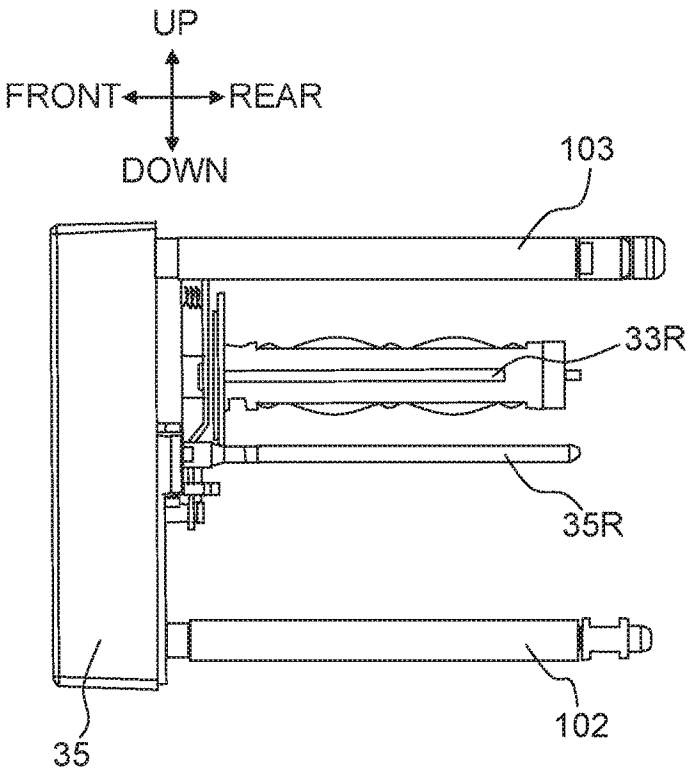
FIG. 4A and FIG. 4B are a front view seen from a front side and a side view seen from a right side respectively, showing the structure of the cassette.
Figure 4A:
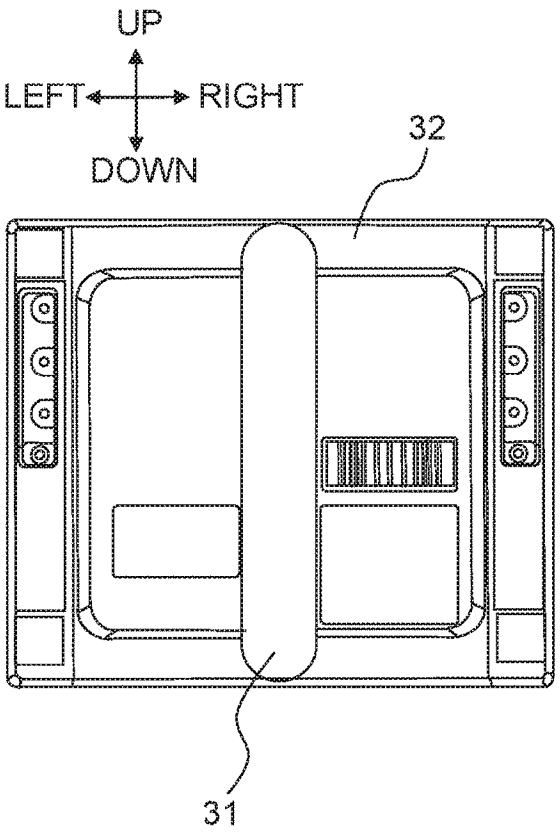
Figure 5:
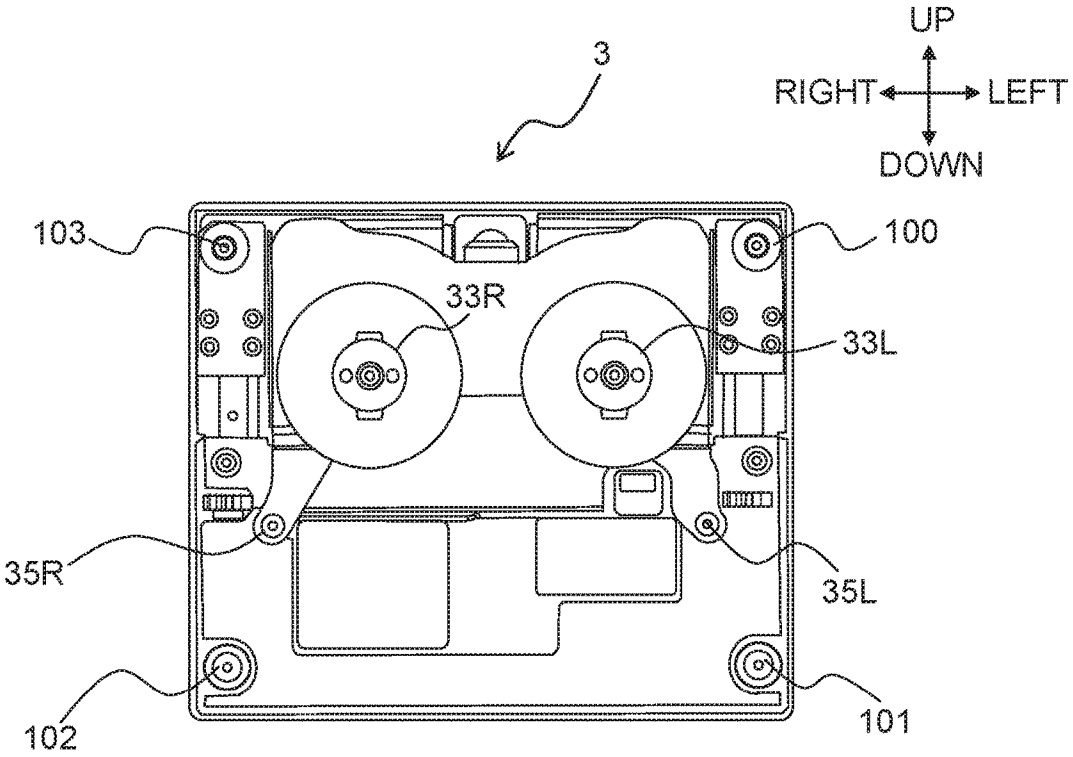
FIG. 5 is a rear view seen from a rear side showing the structure of the cassette.
Figure 11:
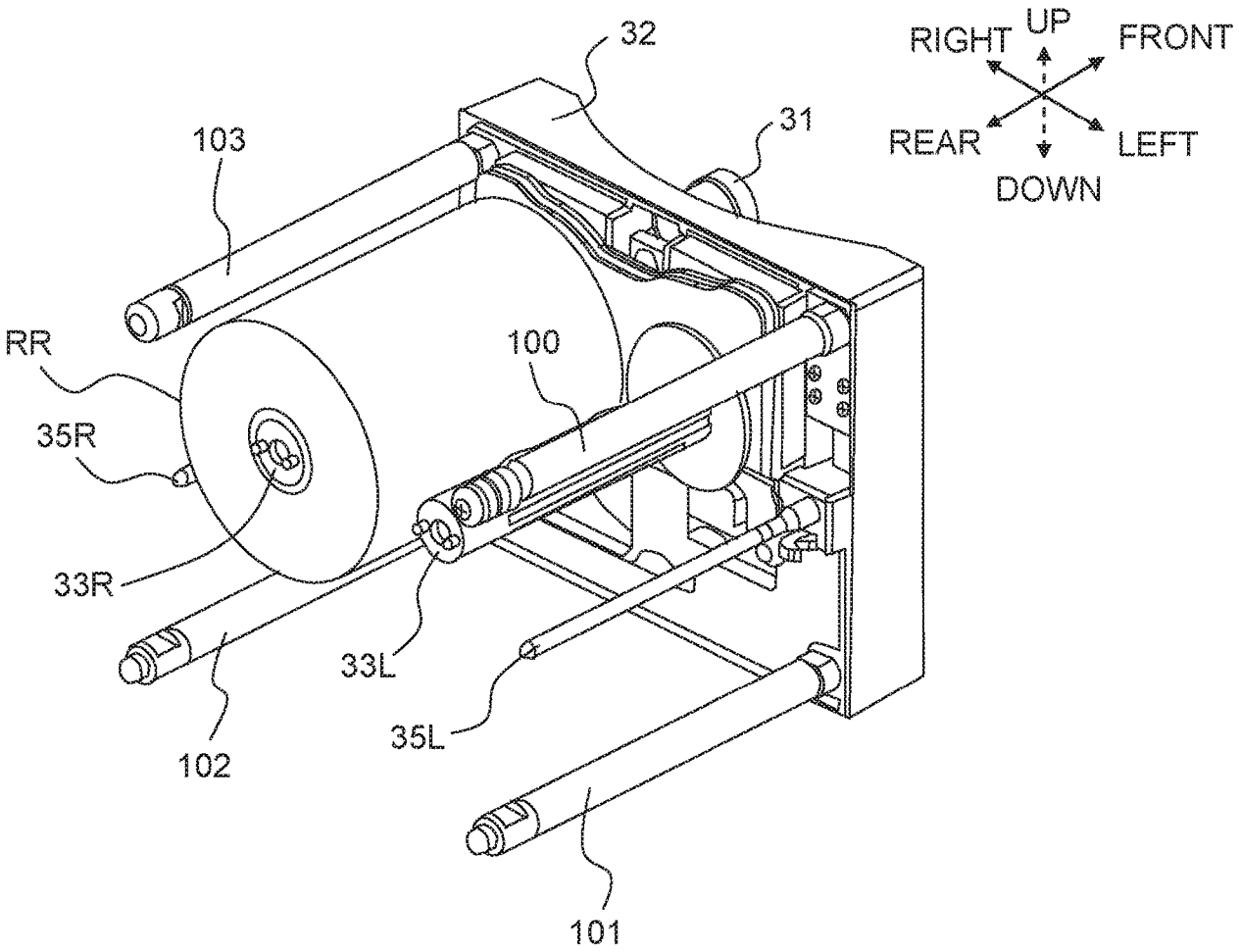
FIG. 11 is a perspective view showing a detailed structure of a cassette that is installed on the printing apparatus main body.

The cassette 3, as depicted in FIG. 3 to FIG. 5 (also refer to FIG. 11 to be described later) includes a cassette base 32 having a substantially rectangular shape, which is positioned at a front side, two roll shafts 33L and 33R, four guide rollers 100, 101, 102, and 103, guide pins 35L and 35R having in the form of a shaft, and a grip 31 provided to the cassette base 32.

The roll shafts 33L and 33R protrude horizontally toward a rear side. The roll shafts 33L and 33R are positioned at a lower side of the guide rollers 100 and 103 which will be described later. The roll shafts 33L and 33R are positioned between the guide rollers 100 and 103 which will be described later, in the left-right direction. One of the two roll shafts 33L and 33R is wound to form a roll. In this example, an ink ribbon R in the form of a belt (refer to FIG. 9 to be described later) is wound around the roll shaft 33L to form a roll (refer to a feeding-side roll RL depicted in FIG. 9). The ink ribbon R that has been wound around is drawn at the time of executing printing that will be described later. Moreover, the other of the two roll shafts 33L and 33R functions as a ribbon take-up roll shaft which winds up the ribbon to form a roll. In this example, the ink ribbon R to which the ink has been transferred is wound up to the roll shaft 33R to form a roll (refer to a take-up side roll RR depicted in FIG. 9). In other words, the roll shafts 33A and 33B are spindles.

The guide rollers 100 to 103 protrude horizontally toward the rear side from a rectangular-shaped four-cornered portion of a rear side of the cassette base 32. The guide rollers 100 and 101 abut with the ink ribbon R drawn from the roll on the roll shaft 33L. Accordingly, the guide rollers 100 and 101 guide the ink ribbon R to a thermal head 42 along a predetermined transportation path (refer to FIG. 9 to be described later). The guide rollers 102 and 103 abut with the ink ribbon R that has been used as described above. Accordingly, the guide rollers 102 and 103 guide the ink ribbon R that is directed toward the roll on the roll shaft 33R.

The guide pins 35L and 35R protrude horizontally from the rear side of the cassette base 32 toward the rear side. The guide pins 35L and 35R are positioned at a lower side of the roll shafts 33L and 33R. The guide pin 35L is positioned at a left side of the roll shaft 33. The guide pin 35R is positioned at a right side of the roll shaft 33R. The guide pins 35L and 35R guide the cassette 3 at the time of installing on the casing 21 of the printing apparatus main body 4.

The cassette base 32 rotatably supports the roll shafts 33L and 33L. Moreover, the cassette base 32 is rotatably supported while being movable in the vertical direction of the guide rollers 100 and 103 out of the guide rollers 100 to 103 (will described later in detail). Furthermore, the cassette base 32 rotatably supports the guide rollers 101 and 102 in a state of positions thereof fixed in the vertical direction. Moreover, the grip 31 is provided to a front side of the cassette base 32. A user, by holding the grip 31 by a hand, can attach and detach the cassette 3 to and from the printing apparatus main body 4.

<Arrangement of Printing Apparatus Main Body>

Figure 6:
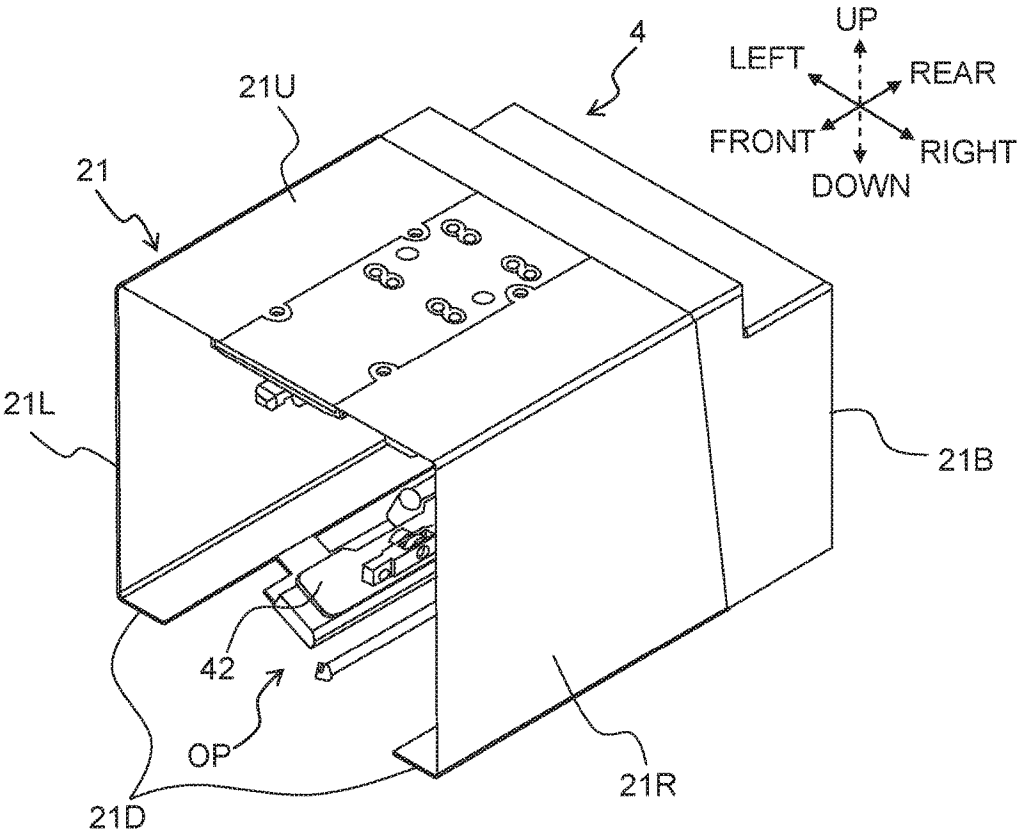
FIG. 6 is a perspective view showing the overall structure of the printing apparatus having the cassette removed from the printing apparatus.

The printing apparatus main body 4, as depicted in FIG. 1, FIG. 2, and FIG. 6, includes the casing 21, and the thermal head 42 which is built-in in the casing 21.

The casing 21 includes an upper wall 21U positioned at an upper side, a pair of side walls 21L and 21R on left and right positioned at a left side and a right side, a rear wall 21B positioned at the rear side, and a lower wall 21D positioned at a lower side, having an opening OP formed therein. The thermal head 42 is arranged to be exposed through the opening OP. The side wall 21L, a left side of the upper wall 21U, and a left side of the lower wall 21D are formed by a single metal plate. Moreover, the side wall 21R, a right side of the upper wall 21U, and a right side of the lower wall 21D are formed by a single metal plate.

Figure 7B:
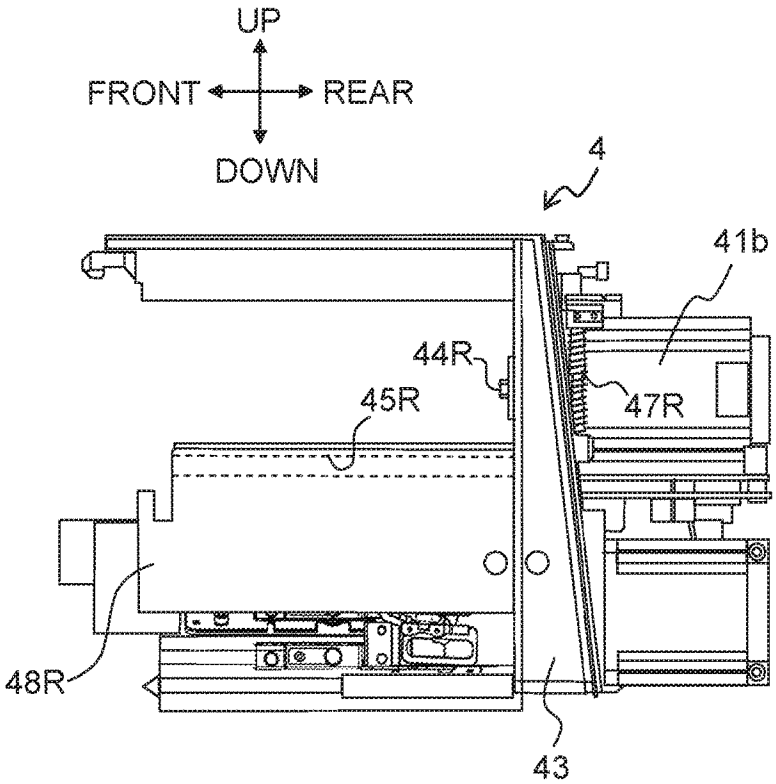
FIG. 7A and FIG. 7B are a front view seen from a front side and a side view seen from a right side respectively, showing a structure of a printing apparatus main body.
Figure 7A:
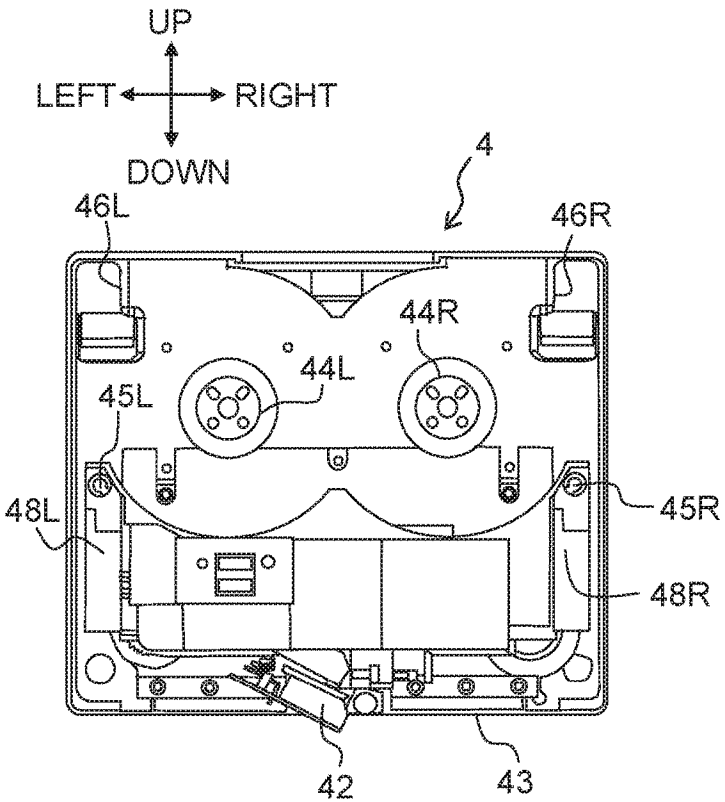
Figure 8:
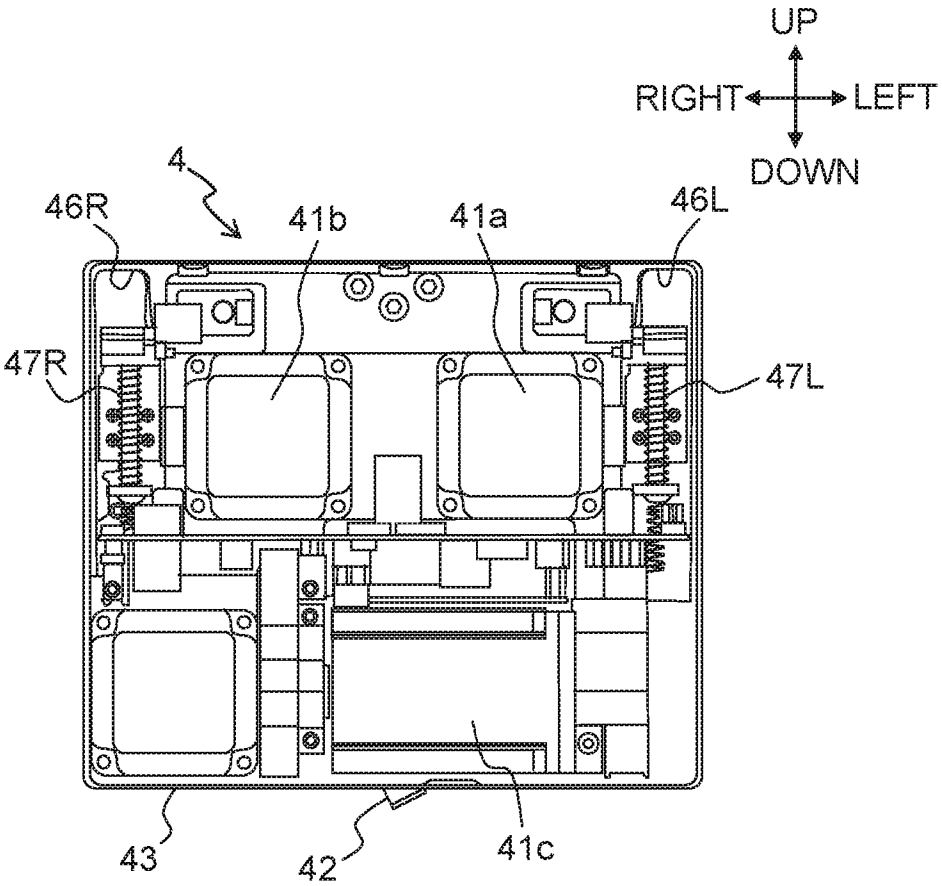
FIG. 8 is a rear view seen from a rear side showing the structure of the printing apparatus main body.

Moreover, the printing apparatus main body 4, as depicted in FIG. 7 and FIG. 8, includes a base 43 having a substantially rectangular shape. The base 43 has a surface which is directed toward the front side, and a direction orthogonal to the base 43 refers to a normal direction of the surface directed toward the front side (frontward direction for example), and a direction opposite to the normal direction (rearward direction for example). Moreover, a direction parallel to the base 43 is a direction parallel to the surface directed toward the front side (in other words, a direction orthogonal to the normal direction), and is the vertical direction and the left-right direction. A drive motor 41*a*, a drive motor 41*b*, a drive motor 41*c*, a roll-shaft receiving portion 44L, a roll-shaft receiving portion 44R, and guide members 48R and 48L are provided to the rear side of the base 43. The drive motor 41*a* rotationally drives the roll shaft 33L. The drive motor 41*b* rotationally drives the roll shaft 33R. The drive motor 41*c* displaces the thermal head 42 in the vertical direction. The roll-shaft receiving portion 44L (first installing portion for example) supports a front end of the roll shaft 33L in a state of being abutted. In other words, the roll-shaft receiving portion 44L rotatably supports the ink ribbon R in the form of a roll wound around the roll shaft 33L. The roll-shaft receiving portion 44L is rotationally driven by the drive motor 41*a*. The roll-shaft receiving portion 44R (second installing portion for example) on a take-up side supports a front end of the roll shaft 33R in a state of being abutted. In other words, the roll-shaft receiving portion 44R supports the ink ribbon R in the form of a roll wound to the roll shaft 33R. The roll-shaft receiving portion 44R is rotationally driven by the drive motor 41*b*. The guide members 48R and 48L regulate horizontal holes 45R and 45L which position by being engaged with front ends of the guide pins 35L and 35R respectively.

Moreover, guide receiving portions 46L and 46R are formed in the base 43. The guide receiving portions 46L and 46R are through holes in the base 43 in the front-rear direction. The guide receiving portions 46L and 46R support front ends of the guide rollers 100 and 103 respectively while being passed through, in order to allow the displacement of the guide rollers 100 and 103. At this time, spring members 47L and 47R which apply a tension to the ink ribbon R by the guide rollers 100 and 103 by coming closer to these guide receiving portions 46L and 46R, are provided to a rear side of the base 43. Details of tension adjustment will be described later.

Figure 9:
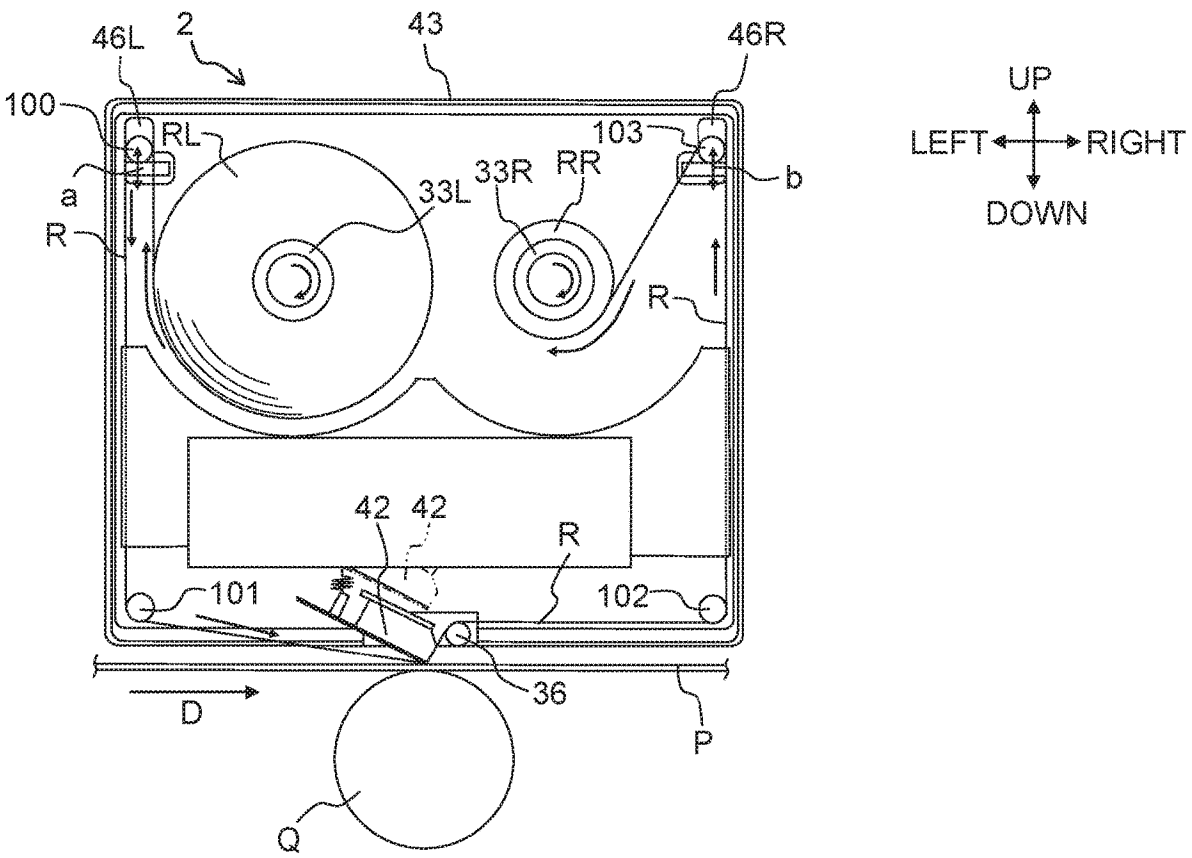
FIG. 9 is a schematic diagram showing the printing apparatus conceptually.

Schematic diagrams showing conceptually the printing apparatus 2 in a state of the cassette 3 installed on the printing apparatus main body 4 having the abovementioned arrangement, is depicted in FIG. 9 corresponding to FIG. 7.

As depicted in FIG. 9, the ink ribbon R is wound around the roll shaft 33L, and thereby a feed roll RL is formed. The feed roll RL is a ribbon feeding roll for example. The ink ribbon R is wound around the roll shaft 33R and thereby a take-up roll RR is formed. The roll shaft 33R is a ribbon take-up roll for example. The ink ribbon R drawn from the feed roll RL, while being guided by the guide rollers 100 and 101, is guided to the thermal head 42 provided to the transportation path of the ink ribbon (ribbon path for example). At this time, an image receiving body P is transported between the thermal head 42 and a platen roller Q provided separately outside the printing apparatus 2. The ink ribbon R is guided between the image receiving body P and the thermal head 42. The thermal head 42 heats the ink ribbon R, and transfers an ink from the ink ribbon R to the image receiving body P. The ink ribbon R after the transfer of ink, is wound up to the take-up side roll RR while being guided by the guide rollers 102 and 103.

The thermal head 42 can be brought closer to and made to be retracted from the platen roller Q by moving in the vertical direction. In other words, the thermal head 42 is normally at a standby position (refer to dotted and dashed lines in FIG. 2), and presses the ink ribbon R toward the platen roller Q while making a contact with the ink ribbon at the time of printing. For this reason, in the base 43, a guide bar 36 of the ink ribbon R is arranged near the thermal head 42.

<Tension-Detection and Transportation-Amount Detection in Guide Roller 100>

In the printing apparatus 2 having the abovementioned arrangement and operation, a technical feature of the present embodiment is that a detection of an amount transported of the ink ribbon R and an adjustment of a tension in the ink ribbon R are carried out by using the guide roller 100. Details thereof will be described below step by step.

<Guide Roller 100 and Supporting Structure Thereof>

As depicted in FIG. 10 to FIG. 15, the guide roller 100, as mentioned above, is passed through the guide receiving portion 46L of the base 43, and extended in a horizontal direction which is orthogonal to the base 43. In this example, the horizontal direction is the front-rear direction. In other words, the horizontal direction can also be referred to as a normal direction of the cassette base 32. The horizontal direction is an example of the second direction. The guide roller 100 includes a shaft sleeve 114 which is hollow and is extended in the front-rear direction, bearings 113F and 113R, a connecting member (coupling member) 115, and two spacers 117F and 117R at the front and the rear. In the following description, 'the guide roller 100 rotates' signifies that at least an outer circumference of the roller (in other words, shaft sleeve 114) rotates, and the overall roller (also including a shaft 112 which will be described later) may not rotate necessarily.

The shaft 112 which is extended in the front-rear direction is provided inside the shaft sleeve 114. The shaft 112 is provided to a rear end of a fastening portion 112A. A screw thread is formed on a front end 112*a* of the fastening portion 112A. Moreover, a flanged portion 112*b* is provided to a rear side of the front end 112*a* of the fastening portion 112A. The flanged portion 112*a* is in the form of a circular cylinder of which two sides are chamfered in order to be able to turn with a spanner. Moreover, the fastening portion 112A is fastened to a shaft receiving plate 131 which is provided to be movable in the vertical direction with respect to the cassette base 32. Accordingly, the shaft 112 (in other words, the guide roller 100) is detachably set in the shaft receiving plate 131 (in other words, to the cassette base 32).

Here, the bearings 113F and 113R are fixed to two ends respectively in the front-rear direction of an outer circumferential portion of the shaft 112. Moreover, the shaft sleeve 114 is provided to the outer peripheral portion of the shaft 112, and is rotatably supported with respect to the shaft 112 by the bearings 113F and 113R. The bearings 113F and 113R include ball bearings for example.

The connecting member 115 is fixed to the shaft sleeve 114 by a pin 118, and is rotatable together with the shaft sleeve 114. The connecting member 115 includes a large-diameter portion 115*a* having the largest outer diameter, a medium-diameter portion 115*b* having an outer diameter smaller than the outer diameter of the large-diameter portion 115*a*, and a small-diameter portion 115*c* having an outer diameter smaller than the outer diameter of the medium-diameter portion 115*b* (in other words, having the smallest outer diameter). These portions of the connecting member 115 are arranged in this order from the front side to the rear side.

Figure 14:
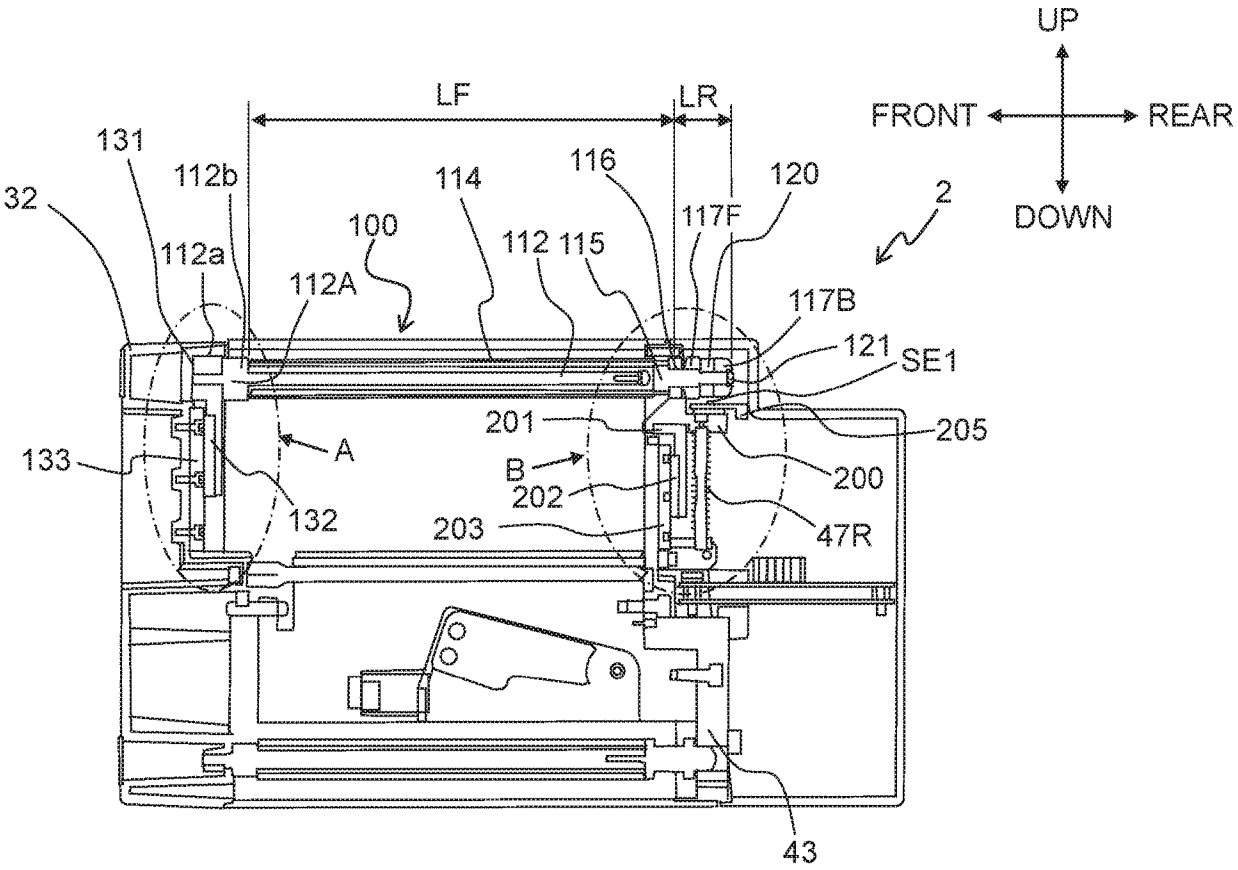
FIG. 14 is a side cross-sectional view by a vertical cross-section including a guide roller 100.

A shaft bearing 116 (a bearing for example) is provided to an outer peripheral side of a front side of the medium-diameter portion 115*b* (in other words, on the large-diameter portion 115*a* side). The shaft bearing 116 is arranged to be in a state of being separated apart rearward from the cassette base 32, and includes an outer ring portion 116*o* which is a fixed member and an inner ring portion 116*i* which is a rotatable member. The inner ring portion 116*i* is fixed to the medium-diameter portion 115*b* of the connecting member 115. Accordingly, the connecting member is rotatably supported by the shaft bearing 116. Particularly, the shaft bearing 116 rotatably supports the connecting member 115 at a position on a rear side of a position where the shaft sleeve 114 and the connecting member 115 are connected. Accordingly, the guide roller 100 is rotatably supported by the shaft bearing 116, and the bearings 113F and 113R. Here, as depicted in FIG. 14, a length LF of the guide roller 100 on a front side (the one side in the second direction for example) of a front-end surface of the shaft bearing 116 is longer than a length LR of the guide roller 100 on a rear side (the other side in the second direction for example) of the front-end surface of the shaft bearing 116. The shaft bearing 116 includes a ball bearing for example.

A magnet 120 (the first detection target member for example) is provided to an outer peripheral side of a portion on a front side of the small-diameter portion 115*c* (in other words, on the medium-diameter portion 115*b* side). In other words, the magnet 120 is provided to a side opposite to the cassette base 32 with respect to the shaft bearing 116, and is fixed to the connecting member 115, at a position on a rear side of the shaft bearing 116 (the one side in the second direction for example). The magnet 120 is a permanent magnet such as a ferrite magnet and a neodymium magnet. Moreover, the abovementioned spacer 117F at the front is provided to an outer peripheral side of a portion on the rear side of the medium-diameter portion 115*b* (in other words, front side of the magnet 120). On the other hand, the aforementioned spacer 117R at the rear side is provided to an outer peripheral side of a portion on the rear side of the small-diameter portion 115*c* (in other words, rear side of the magnet 120). Moreover, a screw 121 is screwed into a rear-end portion of the small-diameter portion 115*c*, from the rear side of the spacer 117R. The spacer 117F, the magnet 120, and the spacer 117R are pinched or clamped between a rear end surface of the shaft bearing 116 fixed to the front side of the aforementioned medium-diameter portion 115*b* and a front end surface of the screw 121. Accordingly, the spacer 117F, the magnet 120, and the spacer 117R are fixed to the connecting member 115. As a result, the magnet 120, while being positioned at a rear side of the shaft bearing 116 by the spacers 117F and 117R, is fixed to the connecting member 115 (in other words, to the guide roller 100), and rotates integrally with the guide roller 100 (more specifically, integrally with the shaft sleeve 114).

<Vertically-Moving Movable Member>

The shaft bearing 116 which rotatably supports the guide roller as described above is provided to be movable in the vertical direction. Therefore, in the present embodiment, a movable member 200 which is movable along the vertical direction, which is parallel to the base 43, is held by the base 43. The vertical direction is a direction orthogonal to the axial direction, and is also referred to as an orthogonal direction or the first direction.

A slid plate (sliding plate) 201 having an L-shape is fixed to a lower portion of the movable member 200. A sliding table 202 is fixed to a front side of the slide plate 201. The sliding table 202 is engaged with a rail 203 which is fixed to the base 43, and slides on the rail 203. In other words, the sliding table 202 and the rail 203 function as the first linear guide. A commercially-available linear guide can be used as the sliding table 202 and the rail 203. Accordingly, the movable member 200 is slidable in the vertical direction by a guiding function of the sliding table 202 and the rail 203. On the other hand, an upper-end portion of the spring member 47L which is a compression spring, is fixed to a lower-end portion of the movable member 200. Instead of a compression spring, an extension spring provided between an upper-end inner surface of the casing 21 and the movable member 200 may be used. A lower-end portion of the spring member 47L is fixed to the base 43. Accordingly, an upward thrust is applied to the movable member 200 by a bias applied by the spring member 47L. As a result, the movable member 200 is pushed upward by the bias applied by the spring member 47L, in a state of being guided by the sliding table 202 and the rail 203.

Figure 10:
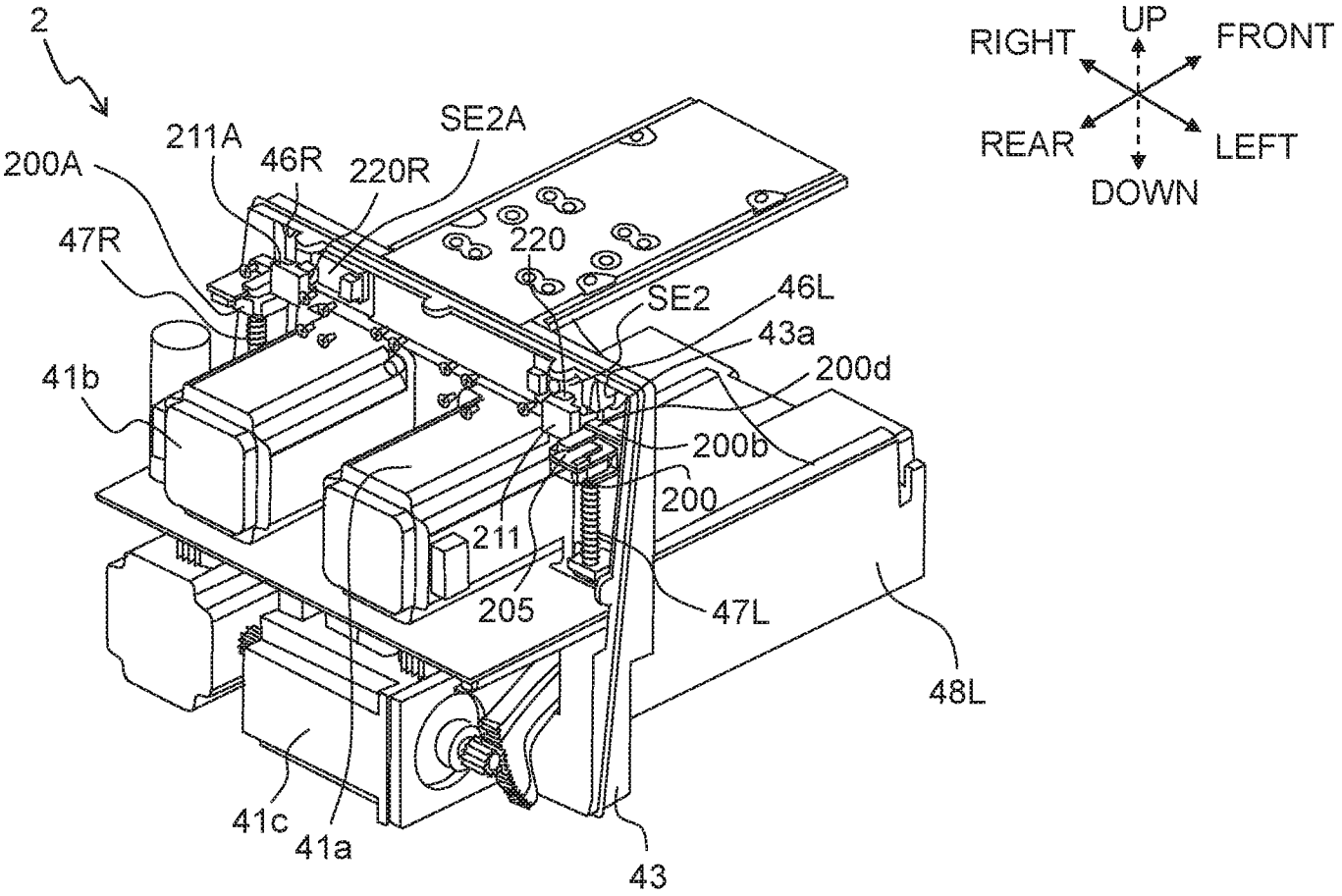
FIG. 10 is a perspective view showing a detailed structure of the printing apparatus main body.

When the movable member 200 moves vertically as described above, a lower limit of a position thereof is regulated by an abutting surface 201*x* positioned at a lower portion of the slide plate 201 being abutted with a stopper portion 203*x* which is an upper end of the rail 203. Similarly, an upper limit of a position in the vertical movement of the movable member 200 is regulated by a right end 200*d* of a bearing holding portion 200*b* of the movable member 200 being abutted with a lower surface of a stopper portion 43*a* which is an upper-side wall of the right end 200*d* provided to the base 43 as depicted in FIG. 10. The upper-side wall of the right end 200*d* is a wall positioned on a right side of the guide roller 100 at the time of installing the guide roller 100. A range (the first range for example) in which the movable member 200 can move vertically from the upper limit up to the lower limit at this time is set to be ±4 mm for example. The two stopper portions correspond to the first stopper. The first range is defined with reference to a center (axis of rotation) of the guide roller 100 for example.

In one case, the movable member 200 is positioned at a sensor holding portion 200*a* which is positioned at a rear side, and at a front side (for example, the one side in the second direction) of the sensor holding portion 200*a*. Moreover, the movable member 200 includes a bearing holding portion 200*b* which protrudes toward the upper side (the one side in the first direction for example) from the sensor holding portion 200*a*. The bearing holding portion 200*b* is a flat surface extended in the front-rear direction and the left-right direction. The bearing holding portion 200*b* holds the shaft bearing 116 by making a contact with a lower end of the shaft bearing 116 (the outer-ring portion 116*o* in particular) which rotatably supports the guide roller 100. Accordingly, the shaft bearing 116 is supported by the movable member 200. Moreover, the movable member 200, at a front side of the bearing holding portion 200*b* (the first side in the second direction for example) is provided with an inclined surface 200*c* which is inclined downward (the other side in the first direction for example) as the bearing holding portion 200*b* is separated apart from the front side (the one side in the second direction for example).

<Detection of Amount of Rotation by First Sensor>

Here, a mounting stage 205 is fixed to an upper portion of the sensor holding portion 200*a*. The mounting stage 205 is a circuit board for example. A magnetic sensor SE1 (the first sensor for example) is provided to an upper portion of the mounting stage 205, to be facing the magnet 120 in the vertical direction. In other words, the magnetic sensor SE1 is held by the sensor holding portion 200*a* via the mounting stage 205, and detects the rotation of the magnet 120 which rotates together with the guide roller 100. The magnetic sensor SE1 includes a hall element for example.

Figures 15A, 15B:
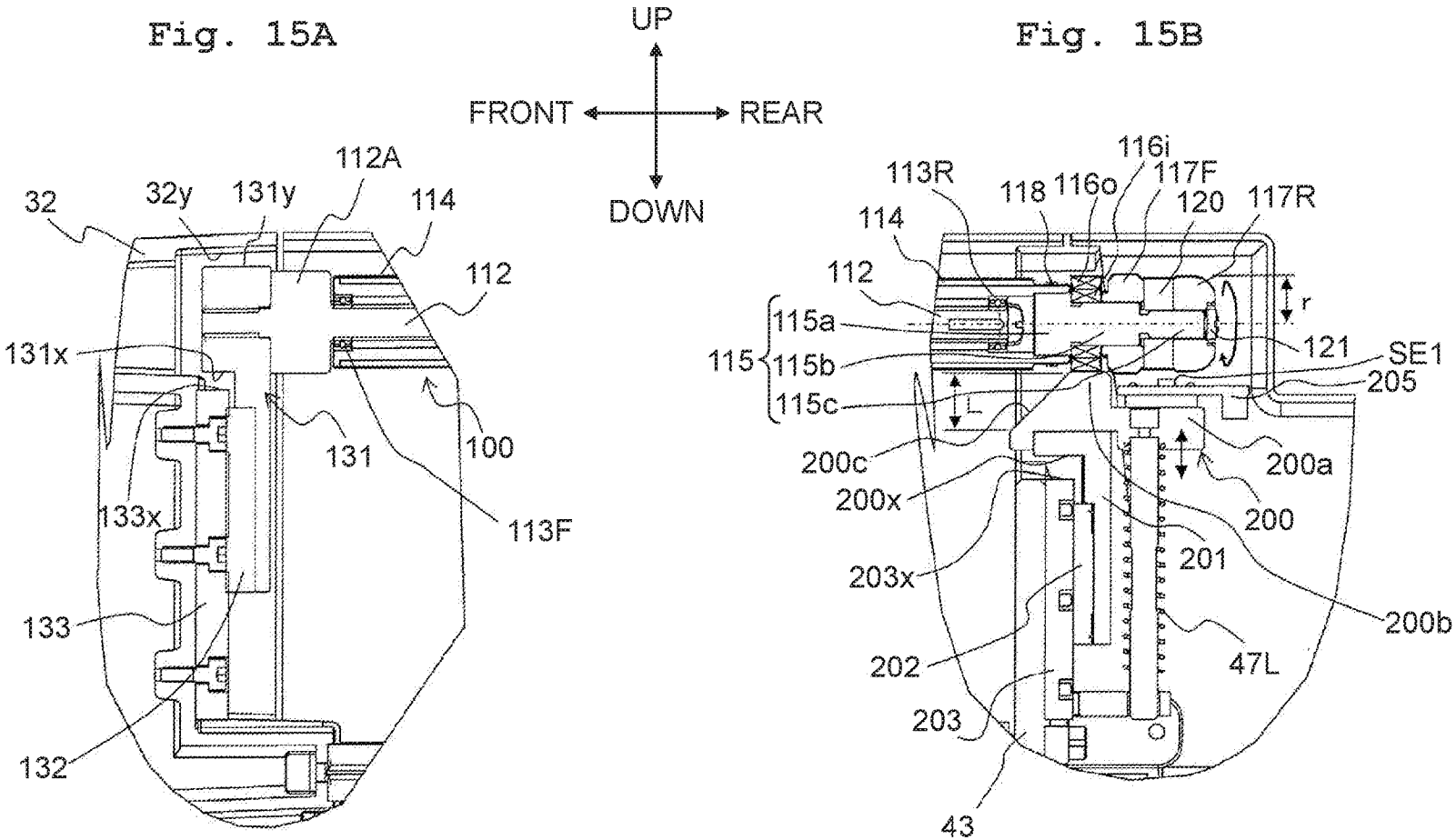
FIG. 15A and FIG. 15B are enlarged views of a portion A and a portion B respectively, in FIG. 14.
Figure 16A:
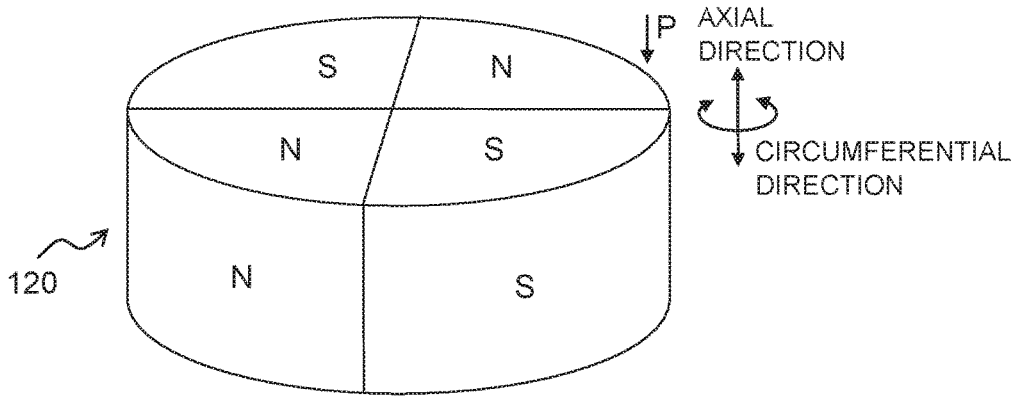
FIG. 16A is a perspective view showing a conceptual arrangement of a magnet and FIG. 16B is a view from a direction of an arrow in a direction Pin FIG. 16A, showing a behavior of lines of magnetic force of a magnet.
Figure 16B:
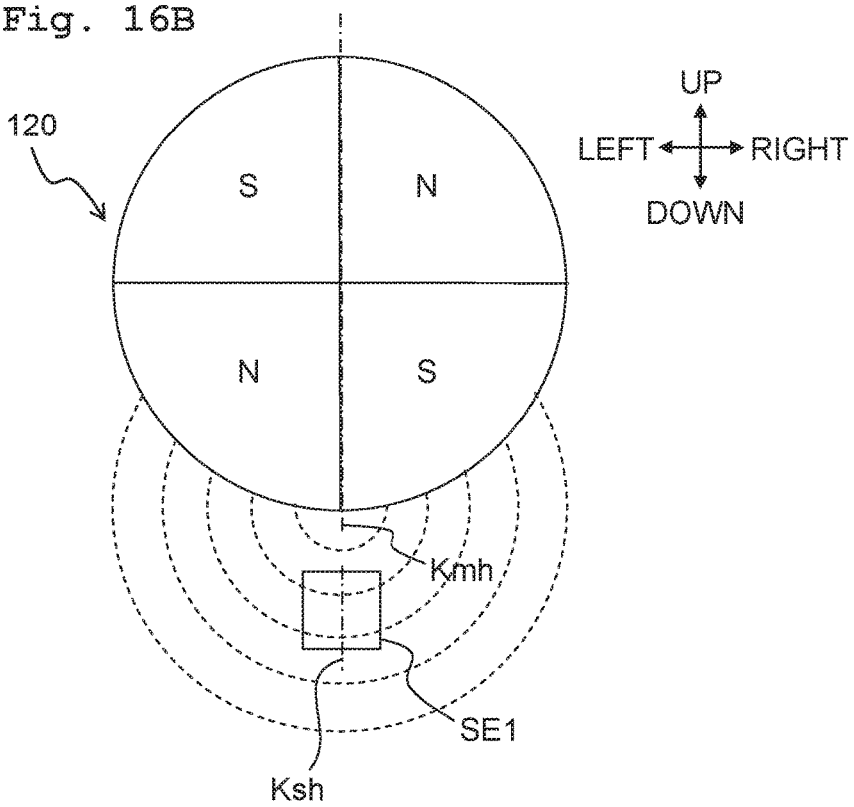

In other words, as depicted in FIG. 16A, same magnetic poles of the magnet 120 are arranged consecutively in the axial direction, and different magnetic poles of the magnet 120 are arranged alternately in a peripheral direction. Moreover, as depicted in FIG. 16B, the magnet 120 is arranged such that a center line Ksh in the left-right direction of the magnetic sensor SE1 extended in the vertical direction coincides with a center line Kmh in the left-right direction of the magnet 120 extended in the vertical direction. When viewed from the front-rear direction, a position of the magnetic sensor SE1 in the front-rear direction (the second direction for example) coincides with a center position of the magnet 120 in the front-rear direction as depicted in FIG. 15B. More specifically, the center position of the magnet 120 in the front-rear direction is included in an area in the front-rear direction between a front end and a rear end of the magnetic sensor SE1. By such arrangement of the magnet 120, a magnetic field strength varies in a peripheral direction. More specifically, in the circumferential direction, the magnetic strength is extremely weak at a boundary position of magnetic poles, and the magnetic strength is extremely strong at a position farthest from the boundary of the magnetic poles. It is possible to detect an amount of rotation of the magnet 120 by counting the number of times for which the magnetic strength detected becomes extremely strong and extremely weak.

The amount of rotation of the guide roller 100 detected as described above is output from the magnetic sensor SE1 to a controller which is not depicted in the diagram. Since the guide roller 100 has a function of guiding the ink ribbon R that is transported as mentioned above, an amount transported of the ink ribbon R corresponds to the amount of rotation of the guide roller 100. Since an outer diameter of the guide roller 100 is known, the controller is capable of detecting the amount of the ink ribbon R transported, on the basis of the amount of rotation of the guide roller 100 that has been input. On the basis of the detection result, the controller controls the drive motors 41*a* and 41*b* which rotationally drive the roll shafts 33L and 33R respectively, and is capable of adjusting an actual speed of transporting the ink ribbon R, to an appropriate value. More specifically, the controller is capable of calculating a diameter of the ink ribbon R from a rotational speed of the drive motors 41*a* and 41*b* and an input pulse from an encoder which detects a speed of transporting an image receiving body provided to equipment for transporting the image receiving body P not depicted. Moreover, by adjusting the rotational speed of the drive motors 41*a* and 41*b* to an appropriate value, it is possible to adjust the speed of transporting the ink ribbon R, to an appropriate value.

The method for detecting the amount of rotation of the guide roller 100 is not restricted to a magnetic method by the magnetic sensor SE1 and the magnet 120 as described above, and a known optical detection method in which an optical encoder (such as a rotary encoder) is used, or another known method of non-contact detection, may be used.

<Vertical-Movement Detection by Second Sensor>

Figure 12:
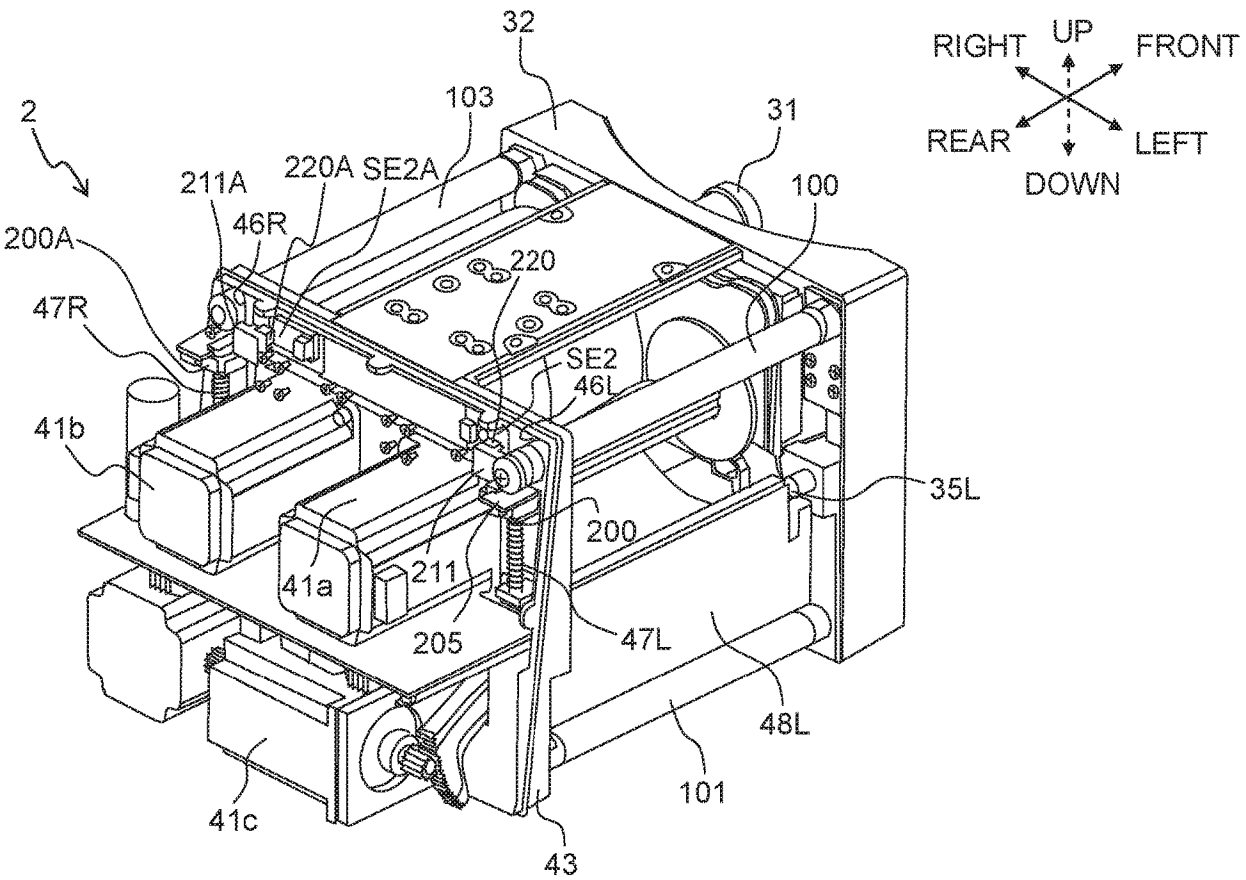
FIG. 12 is a perspective view showing the cassette depicted in FIG. 11 in a state of being installed on the printing apparatus main body in FIG. 10.
Figure 13:
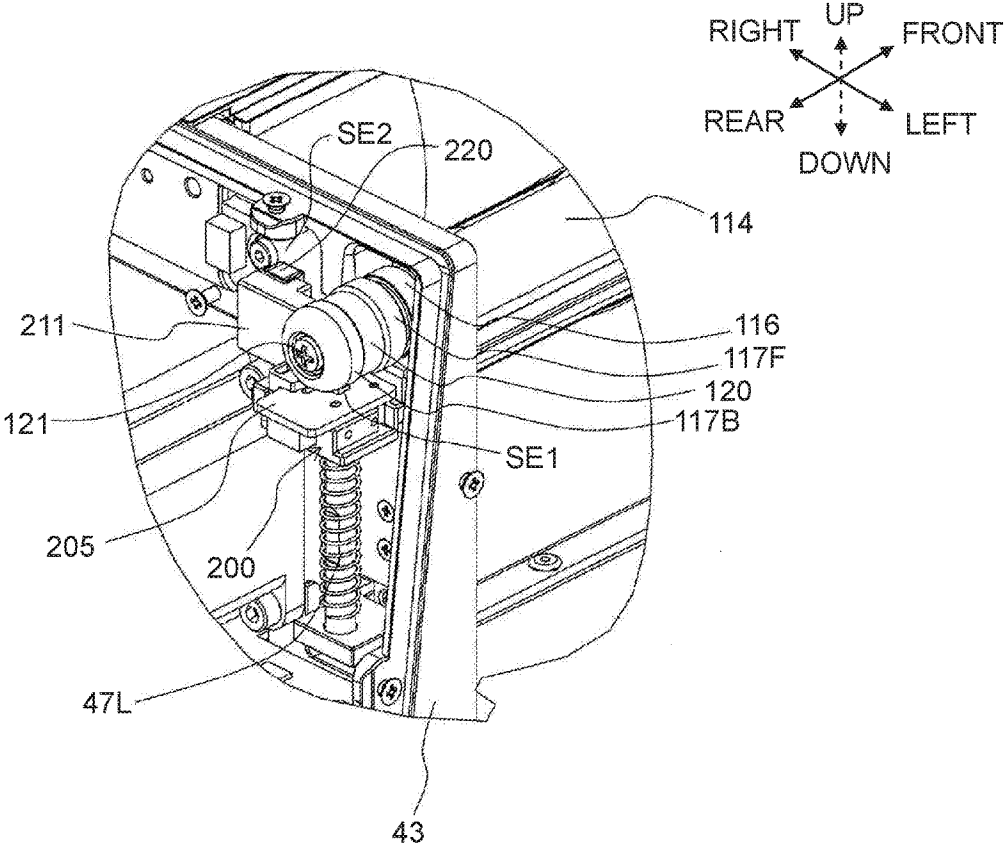
FIG. 13 is an enlarged view of main components, extracted from FIG. 12.

On the other hand, as depicted in FIG. 10, FIG. 12, and FIG. 13, a magnet holder 211 is fixed to an upper right side of the movable member 200. A magnet 220 (the second detection target member for example) is to be fixed to a rear side of the magnet holder 211. In other words, the magnet 220 is provided to the movable member 200 via the magnet holder 211. The magnet holder 220 is a permanent magnet such as a ferrite magnet and a neodymium magnet.

Moreover, a magnetic sensor SE2 (the second sensor for example) is provided to an upper portion of the base 43, to be facing the magnet 220 in the front-rear direction. The magnetic sensor SE2 includes a hall element for example. Here, as mentioned above, by the shaft bearing 116 making a contact with the movable member, the guide roller 100 is held in a state of being movable vertically, while being pushed upward by a bias applied by the spring member 47. The guide roller 100 guides by abutting with the ink ribbon R drawn from the feed-side roll RL (also refer to an arrow a in FIG. 9). Consequently, when the tension in the ink ribbon R becomes high, the guide roller 100 moves downward, resisting the bias applied by the spring member 47L. Whereas, when the tension in the ink ribbon R becomes low, the guide roller 100 moves upward by the bias applied by the spring member 47L. At this time, the magnet 220 provided to the movable member 200 moves in the vertical direction in accordance with the movable member 200 moving vertically together with the guide roller 100 as described above. Accordingly, a position of the magnetic sensor SE2 provided to the base 43 on the fixed side and a position of the magnet 220 change relatively. Accordingly, the strength of a magnetic field of the magnet 220, at the position of the magnetic sensor SE2, changes. The magnetic sensor SE1 detects the position of the magnet 220 (in other words, a position of the movable member 200 and a position of the guide roller 100) on the basis of the magnetic field strength that changes. The position of the guide roller 100 that has been detected is output from the magnetic sensor SE2 to the controller that is not depicted in the diagram. As aforementioned, since the position of the guide roller 100 that moves vertically, corresponds to the magnitude of the tension in the ink ribbon R transported, the controller is capable of detecting the tension in the ink ribbon R on the basis of the position in the vertical direction of the guider roller 100 that has been input. Accordingly, on the basis of the detection result, the controller is capable of adjusting the actual tension in the ink ribbon R by a known appropriate method (including the control of the drive motors 41*a* and 41*b* described above). The method for detecting the position of the guider roller 100, similarly as described above, is not restricted to the method by magnetic detection by the magnetic sensor SE2 and the magnet 220, and a known optical detection method in which an optical encoder is used, or another known method of non-contact detection, may be used.

In the description above, the magnetic sensor SE2 is provided to the base 43 on the fixed side, and the magnet 220 is provided to the movable member 200 on a movable side. However, without restricting to such arrangement, conversely, the magnet 220 may be provided to the base 43 on the fixed side, and the magnetic sensor SE2 may be provided to the movable member 200 on the movable side, and the tension in the ink ribbon R may be calculated on the basis of an amount of relative displacement of the magnet 220 and the magnetic sensor SE2.

The movable member 200, the spring member 47L, the shaft bearings 116, the guide roller 100, the magnet 200, and the magnetic sensor SE1 form a first tension applying mechanism. The first tension applying mechanism adjusts the tension in the ink ribbon R provided to the ribbon path from the feed-side roll RL up to the thermal head 42 as described above.

<Supporting Mechanism for Guide Roller 100 in Cassette 3>

On the other hand, the abovementioned shaft receiving plate 131 which supports the guide roll 100 on the cassette 3 side, is held by the cassette base 32, to be movable along the vertical direction (the first direction for example) which is parallel to the cassette base 32.

In other words, a sliding table 132 fixed to the front side of the lower portion of the shaft receiving plate 131 is engaged with a rail 133 which is fixed to the cassette base, and slides on the rail 133. In other words, the sliding table 132 and the rail 133 function as the second linear guide. A commercially-available linear guide can be used as the sliding table 132 and the rail 133. Accordingly, the shaft receiving plate 131 (in other words, the guide roller 100) is slidable in the vertical direction (linear direction for example) by a guiding function of the sliding table 132 and the rail 133.

When the shaft receiving plate 131 moves vertically in such manner, a lower limit of a position thereof is regulated by an abutting surface 131*x* positioned at a lower side of a front-end portion of the shaft receiving plate 131 being abutted with a stopper portion 133*x* of the rail 133. Similarly, an upper limit of a position in the vertical movement of the shaft receiving plate 131 is regulated by a abutting surface 131*y* positioned at an upper end of the shaft receiving plate 131 being abutted with a stopper portion 32*y* provided to the cassette base 32. A range (the second range for example) in which the shaft receiving plate 131 can move vertically from the upper limit up to the lower limit at this time is set to be ±3 [mm] for instance, which is smaller than the range in which the movable member can move vertically (the first range). The second range is defined with reference to an upper end of the movable member 200 (bearing holding portion 200*b*). Moreover, in the vertical direction, position of a center of the first range and a position of a center of the second range coincide. Here, particularly, in a state of the shaft receiving plate 131 in contact with any of the stopper portions 132*x* and 32*y*, the movable member 200 is in a state of being separated apart from the abovementioned two stopper portions (which is the first stopper). The two stopper portions 133*x* and 32*y* correspond to the second stopper.

Moreover, here, a length L in the vertical direction of the inclined surface 200*c* provided to the abovementioned movable member 200 (refer to FIG. 15B) is not less than a sum of a half of the range in which the movable member 200 is movable vertically (first range), a half of the range in which the shaft receiving plate 131 is movable vertically (second range), and a radius r of the guide roller 100 (refer to FIG. 15B).

The shaft receiving plate 131, and the rail 133 and the sliding table 132 are arranged to be mutually removable, and by removing the shaft receiving plate 131, and the rail 133 and the sliding table, it is possible to remove the shaft 112 (in other words, the guide roller 100) from the cassette base 32. In other words, the guide roller 100 is detachably installed on the sliding table 132 and the rail 133 as the second linear guide.

<Tension Detection in Guide Roller 103>

Even in the guide roller 103, the tension detection and adjustment of the ink ribbon R are carried out by a method similar to that for the guide roller 100 as depicted in FIG. 12.

In other words, the guide roller 103 inserted through the guide receiving portion 46R is rotatably supported with respect to a bearing receiving portion (not depicted in the diagram), similarly as the bearing holding portion 200*b* provided to the movable member 200A similar to the movable member 200. In other words, in the guide roller 103, a shaft similar to the shaft 112 is extended up to a rear-end side as it has been. A portion extended of the guide roller 103 is a large-diameter portion. Here, a shaft sleeve similar to the shaft sleeve 114 is connected to the shaft by the bearings 113F and 113R. The shaft sleeve is rotatably supported by the movable member 200A holding a rear end of the shaft. Although, a diagram and a description in detail is omitted here, the movable member 200A, similarly as the movable member 200, is provided to be movable in the vertical direction while being guided by a rail, and a thrust in the upward direction is applied by a bias applied by the spring member 47R.

Moreover, as depicted in FIG. 12, a magnet holder 211A similar to the magnet holder 211 is installed on an upper side of the movable member 200A, similarly as for the movable member 200. Moreover, a magnet 220A similar to the magnet 220 is fixed to a rear side of the magnet holder 211A. A magnetic sensor SE2A similar to the magnetic sensor SE2 is provided to an upper portion of the base 43, to be facing the magnet 220A in the front-rear direction. Here, the guide roller 103 makes a contact with the movable member 200A as described above. Accordingly, the guide roller 103 is held in a state of being movable vertically while being pushed upward by the bias applied by the spring member 47R, and guides by abutting with the ink ribbon R which is wound up to the take-up roll RR (also refer to an arrow b in FIG. 9). Consequently, when the tension in the ink ribbon R becomes high, the guide roller 103 moves downward, resisting the bias applied by the spring member 47R, and when the tension in the ink ribbon R becomes low, the guide roller 103 moves upward by the bias applied by the spring member 47R. At this time, similarly as described above, the magnet 220A provided to the movable member 200A moves in the vertical direction in accordance with the movable member 200A moving vertically together with the guide roller 103. A position of the magnet 220A (in other words, a position of the movable member 200A and the guide roller 103) is detected on the basis of a change in a magnetic strength from the magnet 220 to the magnetic sensor SE2A similarly as described above. The position of the guide roller 103 that has been detected is output from the magnetic sensor SE2A to the controller, and the tension in the ink ribbon R is detected on the basis of the position of the guide roller 103 that has been input, and the controller adjusts the actual tension in the ink ribbon R by a known appropriate method (including the control of the drive motors 41*a* and 41*b* described above) on the basis of the tension that has been detected.

The movable member 200A, the spring member 47R, and the shaft bearings which are provided to a ribbon path from the thermal head 42 up to the take-up side roll RR, and which adjust the tension in the ink ribbon R, form a second tension applying mechanism. The second tension applying mechanism does not include an arrangement as the magnet 200 and the magnetic sensor SE1.

<Effect of Embodiment>

As described above, in the printing apparatus 2 of the present embodiment, the guide roller 100 which guides the ink ribbon R is rotatably supported by the shaft bearing 116. Moreover, the shaft bearing 116 is supported by the movable member 200 which is held by the base 43, to be movable in the vertical direction. Accordingly, the guide roller 100 is movable in the vertical direction with respect to the base 43, together with the movable member 200. Moreover, since the upward bias is applied to the movable member 200 by the spring member 47L, it is possible to adjust the tension applied to the ink ribbon R in the manner described above.

The magnet 120 is provided integrally to the guide roller 100, and rotates integrally with the guide roller 100. Moreover, the magnetic sensor SE1 is provided to be facing the magnet 120. Accordingly, the rotation of the magnet 120 (in other words, the rotation of the guide roller 100) is detected by the magnetic sensor SE1. Since the outer diameter of the guide roller 100 is known, it is possible to detect the amount of the ink ribbon R transported, on the basis of the amount of rotation of the magnet 120.

As a result, according to the present embodiment, the movable member 200, the spring member 47L, the shaft bearing 116, the magnet 120, and the magnetic sensor SE1 are provided around one guide roller 100. Therefore, it is possible to carry out both of the adjustment of the tension in the ink ribbon R and the detection of the amount of the ink ribbon R transported. As a result, as compared to the conventional structure in which the tension adjustment mechanism, and the sensor assembly which detects the amount of the ink ribbon R transported, are provided separately as described above, it is possible to reduce a space for installation, and to facilitate the small-sizing of the printing apparatus 2.

Moreover, in the present embodiment, particularly, the guide roller 100 is detachably installed on the cassette base 32 (more specifically, the sliding table 132) by the fastening portion 112A or the shaft receiving plate 131 described above. Accordingly, in the cassette 3, it is possible to remove and separate the guide roller 100 from the cassette base 32.

Moreover, in the present embodiment, particularly, the movable member 200 includes the inclined surface 200*c* positioned at the front of the bearing holding portion 200*b*. The inclined surface 200*c* is inclined to a lower side as separating away toward the front side from the bearing holding portion 200*b*. In other words, the inclined surface 200*c* is inclined upward toward the rear side. Accordingly, at the time of installing the cassette 3 along the front-rear direction on the base 43 of the printing apparatus main body 4 (refer to FIG. 10 and FIG. 12), the front end of the guide roller 100 toward the base 43 is capable of pushing the inclined surface 200*c* toward the rear side. Accordingly, the guide roller 100 is supported by the movable member 200, while pushing the movable member 200 downward. As a result, it is possible to install the cassette 3 in a quick and efficient manner, and to support the guide roller 100 supported on the cassette 3 side, even at the printing apparatus main body 4 side via the movable member 200.

Moreover, in the present embodiment, particularly, the printing apparatus main body 4 includes the magnet 220 provided to the movable member 200, and the magnetic sensor SE2 provided to the base 43, to be facing the magnet 220, which detects the position of the magnet 220.

In an arrangement in which the guide roller 100 (together with the movable member 200) is movable in the vertical direction with respect to the base member 43 as described above, it is possible to detect the magnet 220 by the magnetic sensor SE2 which is displaced relatively with respect to the magnet 220. Accordingly, it is possible to detect assuredly, the position of the guide roller 100 in the vertical direction. As a result, it is possible to detect the tension in the ink ribbon R, and to carry out assuredly the tension adjustment by a drive control of the drive motors 41*a* and 41*b*. At this time, particularly, it is possible to provide the magnet 220 to the movable member 200, and to provide the magnetic sensor SE2 to the base 43. Accordingly, unlike in a case in which the magnet 220 is provided to the base 43, and the magnetic sensor SE2 is provided to the movable member 200, it is possible to let the structure to be such that the magnetic sensor SE2 is not moved. Normally, the structure is such that the magnetic sensor SE2 is connected to the base 43 by a harness.

Moreover, in the present embodiment, particularly, by letting an arrangement to be such that the magnets 120 and 220 are detected by the magnetic sensors SE1 and SE2, it is not susceptible to have an effect of disturbance due to dust, unlike in a case of carrying out the detection optically.

Moreover, in the present embodiment, particularly, as depicted in FIG. 16A, same magnetic poles of the magnet 120 are arranged consecutively in the axial direction, and different magnetic poles of the magnet 120 are arranged alternately in a peripheral direction, and furthermore, the center position Kmh in the horizontal direction of the magnetic sensor SE1 coincides with the center position Ksh in the horizontal direction of the magnet 120. This arrangement has the following significance.

Figure 17A:
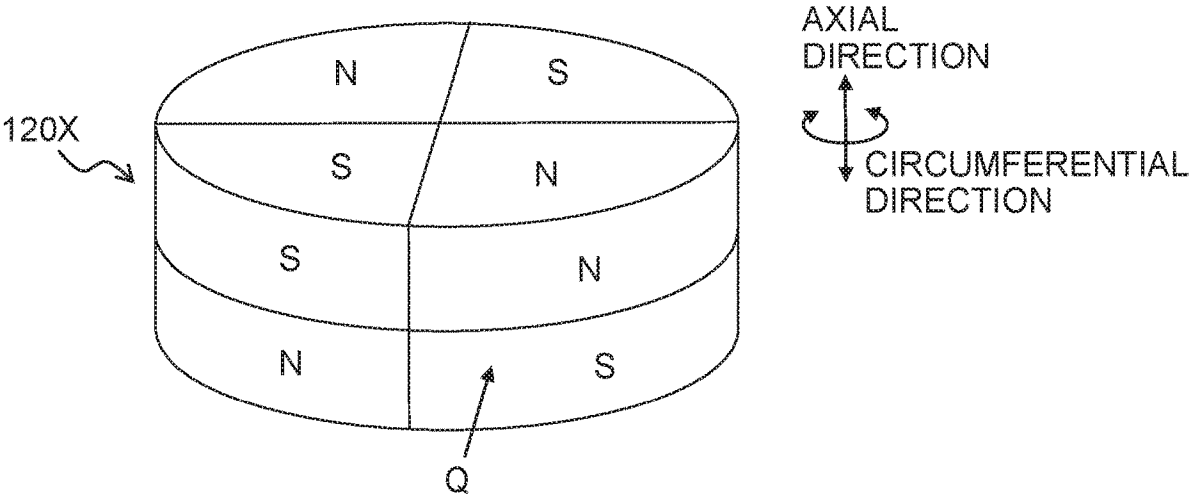
FIG. 17A is a perspective view showing a conceptual arrangement of a magnet when different magnetic poles are arranged in an axial direction.
Figure 17B:
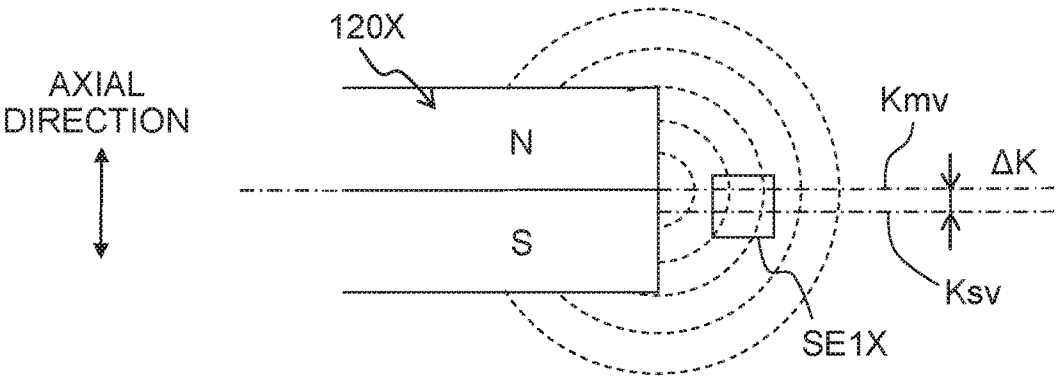
FIG. 17B is a view from a direction of an arrow in a direction Q, showing a behavior of lines of magnetic force of the magnet.
Figure 18:
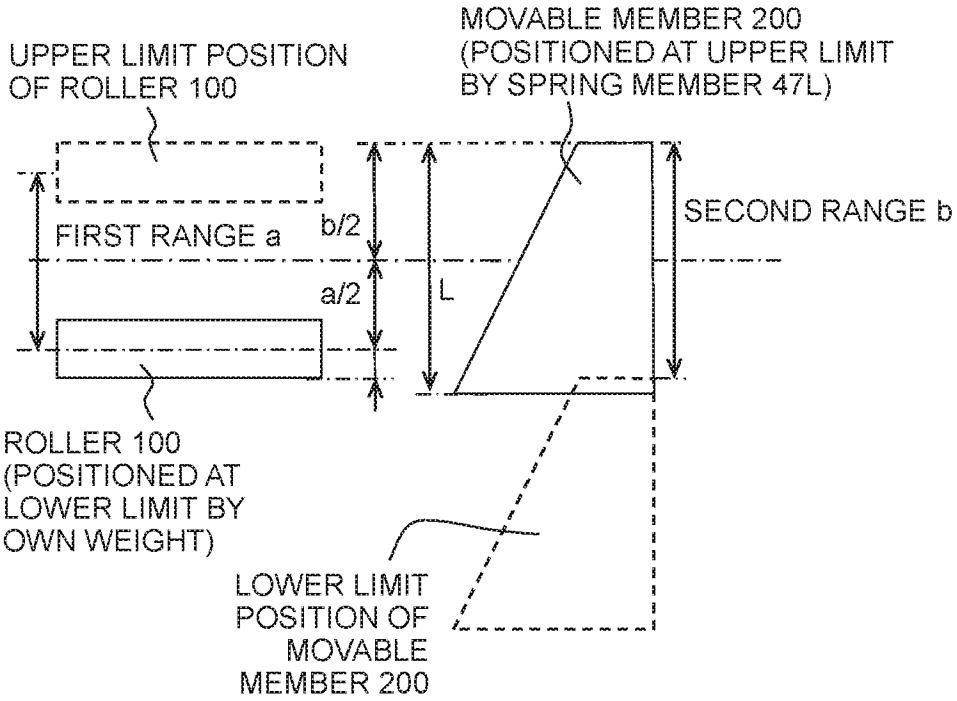
FIG. 18 is a schematic diagram for explaining a dimensional relationship for lifting up a guide roller by an inclined surface.

In other words, even in a case of a magnet 120X in which different magnetic poles are arranged in the axial direction as depicted in FIG. 17A for example, it is possible to detect the rotation by the magnetic sensor SE1. Consequently, it is possible to use the magnet 120X as the first detection target member. However, in a case in which the magnet 120X is used, as the lines of magnetic force form a loop in the axial direction as depicted in FIG. 17B, the magnetic field strength is weakened at a central position of the axial direction. Therefore, for securing detection accuracy, it is necessary to offset a center line Ksv in the axial direction of a magnetic sensor SE1X and a center line Kmv in the axial direction of the magnet 120X, in the axial direction for example (refer to ΔK in FIG. 17B). As a result, when a dimensional tolerance is taken into consideration, it is necessary to make an offset amount ΔK to be adequately large, which hinders the small-sizing.

Whereas, in the present embodiment, the magnet 120 having the same magnetic poles arranged in the axial direction as depicted in FIG. 16A is adopted. Consequently, the lines of magnetic force form a loop in a radial direction as depicted in FIG. 16B. Therefore, offsetting etc. is not necessary, and it is possible to facilitate the small-sizing assuredly.

Moreover, in the present embodiment particularly, the rail 203 which guides the movable member 200 in the range (first range) parallel to the vertical direction is provided to the base 43, and the rail 133 which guides the guide roller 100 in the range (second range) parallel to the vertical direction is provided to the cassette 3. Accordingly, the guide roll 100 provided to the cassette 3 is guided in the vertical direction by the rail 133 on the cassette base 32 side of the cassette 3. Moreover, on the base 43 side of the printing apparatus main body 4, it is guided in the vertical direction by the rail 203 via the movable member 200 connected via the inclined surface 200*c*. In such manner, it is possible to make a guide structure with both-end support. Consequently, even when a force by the tension in the ink ribbon R is exerted to the guide roller 100, the guide roller 100 is movable in the vertical direction in a state of an inclination of the guide roll 100 reduced.

Moreover, in the present embodiment particularly, the first range (±4 mm in the abovementioned example) of the rail 203 is larger than the second range (±3 mm in the abovementioned example) of the rail 133. The guide range (second range) of the rail 203 is a range of guiding directly the guide roller 100 at the cassette 3 side, and the guide range (first range) of the rail 203 is a range of guiding the movable member 200 at the printing apparatus main body 4 side (in other words, the range of guiding the guide roller 100 indirectly). As mentioned above, the guide range (first range) of the rail 203 is larger than the guide range (second range) of the rail 203. Accordingly, even when there is a variation in the first range and the second range due to a dimensional tolerance, the rail 203 can move in the entire second range assuredly, and it is possible to secure a movable range of the guide roller 100.

Moreover, in the present embodiment particularly, the length L in the vertical direction of the inclined surface 200*c* (refer to FIG. 15B) is not less than the sum of the half of the first range, the half of the second range, and the radius r of the guide roller. This arrangement has the following significance.

As in the present embodiment, in a case in which the printing apparatus main body 4 and the cassette 3 are separate structures, before installing the cassette 3, on the printing apparatus main body 4 side, the movable member 200 is pushed to the upper side by the spring member 47L, and is shifted upward (refer to FIG. 10). Whereas, on the cassette 3 side, the guide roller 100 is shifted to a lower side by a weight of the guide roller 100 (refer to FIG. 11). In this state, in order to guide (lift up) the guide roller 100 by the inclined surface 200*c*, it is necessary that a lower end of the inclined surface 200*c*, when the movable member 200 is positioned at an upper end of the second range, is positioned at a lower side of a lower end of the guide roller 100 when the guide roller 100 is positioned at a lower end of the first range. In the present embodiment, the length L of the inclined surface 200*c* in the vertical direction is not let to be less than ("half of the first range"+"half of the second range"+"radius of the guide roller 100"). Here, as described above, the first range is defined with reference to the center (axis of rotation) of the guide roller 100. The second range is with reference to the upper end (bearing holding portion 200*b*) of the movable member 200. Moreover, the position of the center of the first range and the position of the center of the second range coincide. On such premise, when the first range is indicated as 'a' and the second range is indicated as 'b', by letting the length L not to be less than (a/2+b/2+r), the inclined surface 200*c* is capable of moving the lower end of the guide roller 100 in the vertical direction assuredly.

Moreover, in the present embodiment particularly, the stopper (such as the stopper portion 203*x*) provided to the base 43 is positioned at two ends of the first end, and regulates the first range by making a contact with the movable member 200. Moreover, the stopper portions 132*x* and 32*y* provided to the cassette 3 are positioned at two ends of the second range, and regulate the second range by making a contact with the guide roller 100. Moreover, in a state of the guide roller 100 and the stopper portions 132*x* and 32*y* in contact, the movable member 200 and the stopper (such as the stopper portion 203*x*) are separated apart.

Accordingly, it is possible to set predetermined limits on the guide range of the rail 203 (first range) and the guide range of the rail 133 (second range) by the stopper portion 203*x*, and the stopper portions 132*x* and 32*y* respectively. Moreover, at the time of setting the limits, the movable member 200 and the stopper portion 203 are separated apart in a state of the guide roller 100 and the stopper portions 132*x* and 32*y* in contact. By letting the dimensions to be such dimensions, a function of applying an elastic bias by the spring member 47R is not disabled by the stopper portion 203*x* etc., and it is possible to facilitate using effectively all the time.

The present disclosure is not restricted to the embodiment described above and various modifications without departing from the scope and technical idea of the present disclosure are possible. Such modified example will be described below step by step.

(1) Case of not Using Cassette

In the embodiment, the roll shaft 33L which winds the feed-side roll RL, and the roll shaft 33R which winds the take-up side roll PR were provided to the cassette 3 which is separate from the printing apparatus main body 4. Moreover, the roll shafts 33L and 33R were received by the roll shaft receiving portions 44L and 44R provided to the base 43, and were driven by the drive motors 41*a* and 41*b*. However, the present teaching is not restricted to such arrangement. In other words, the cassette 3 may be omitted, and roll shafts corresponding to the roll shafts 33L and 33R may be provided to the base 43, and the roll shafts provided may be driven directly by motors. Such modified example will be described below by referring to FIG. 19 to FIG. 22.

<Schematic Structure of Printer>

Figure 19:
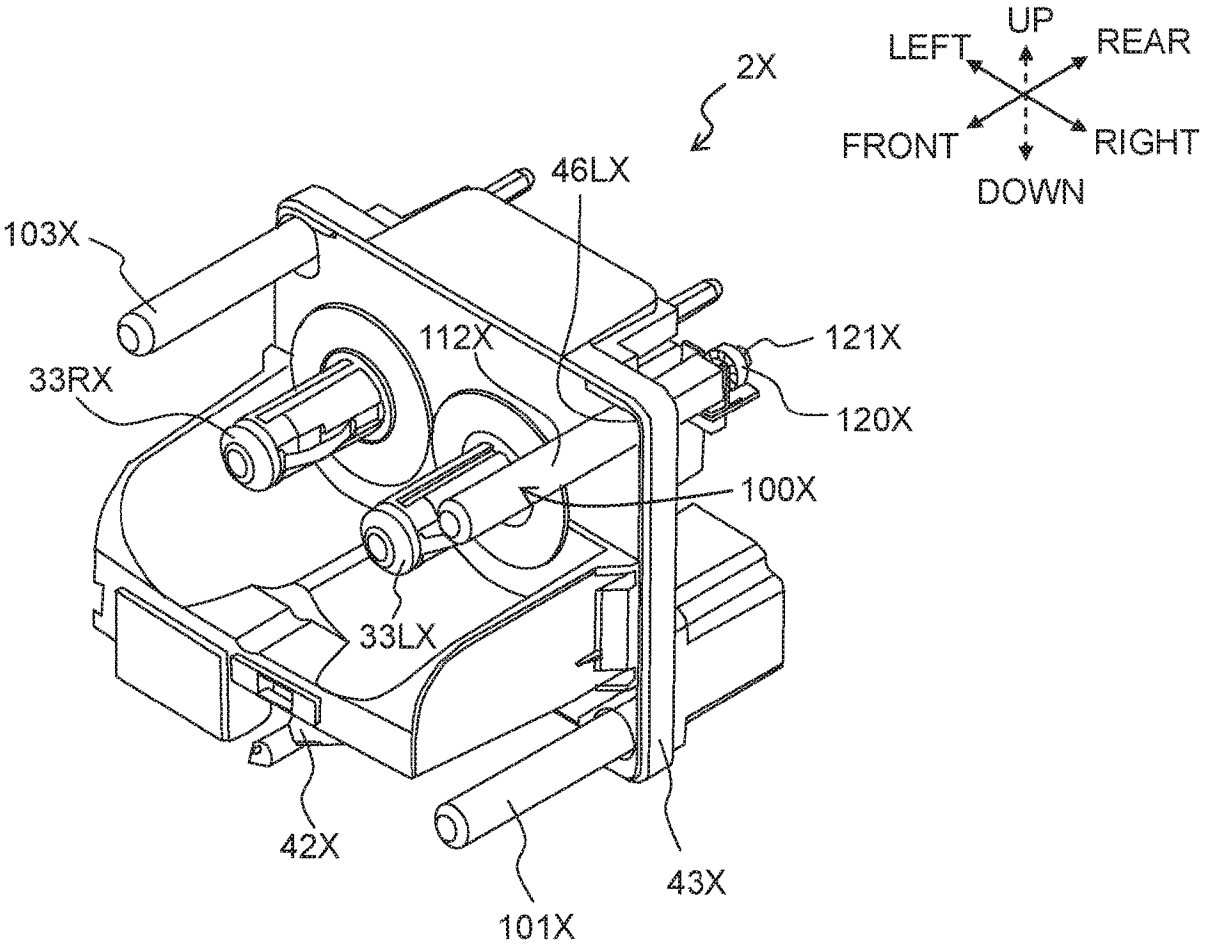
FIG. 19 is a perspective view showing an overall structure of a printing apparatus according to a modified example, not using a cassette.
Figure 20:
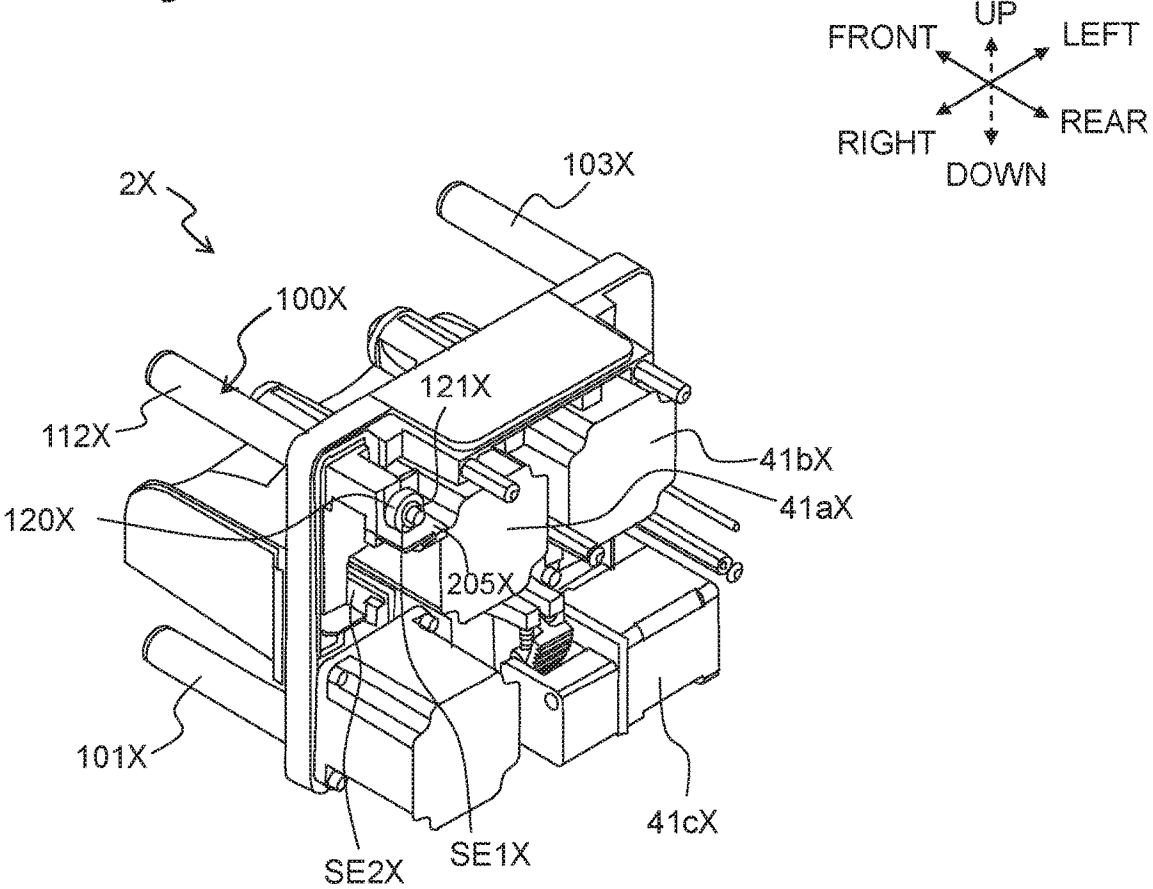
FIG. 20 is perspective view when the printing apparatus is seen from another direction.
Figure 21:
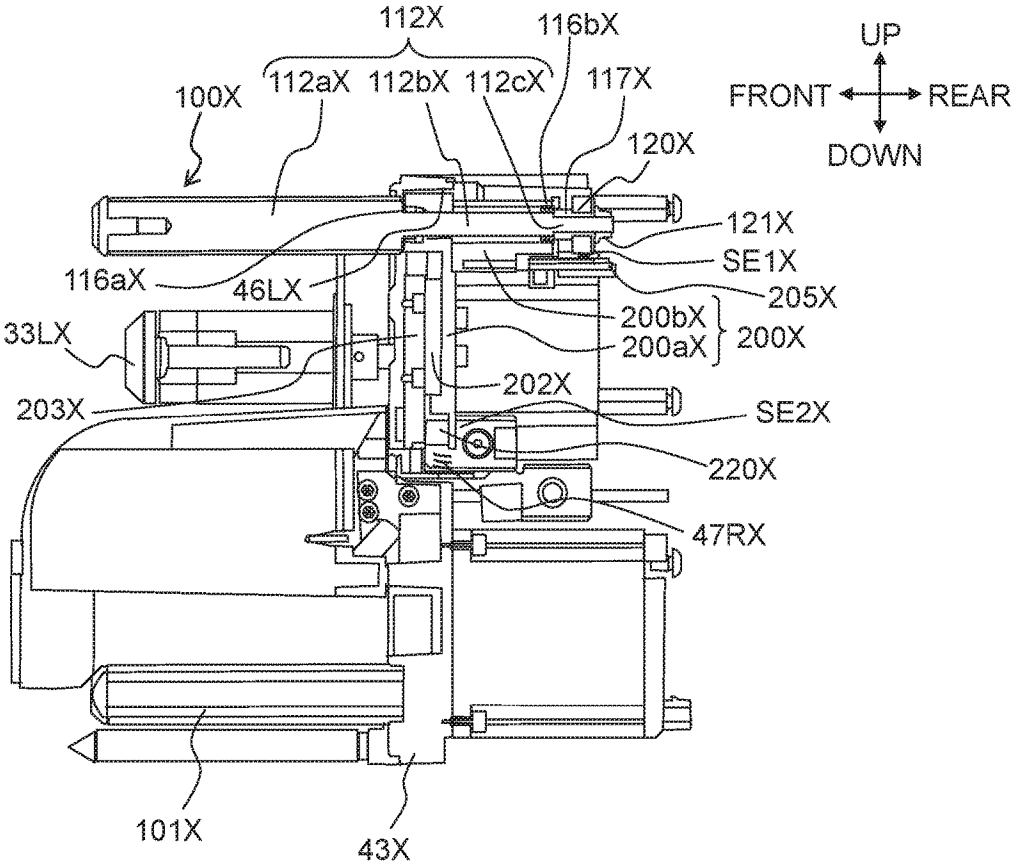
FIG. 21 is a side cross-sectional view by a vertical cross-section including a guide roller 100X in a structure depicted in FIG. 20.
Figure 22:
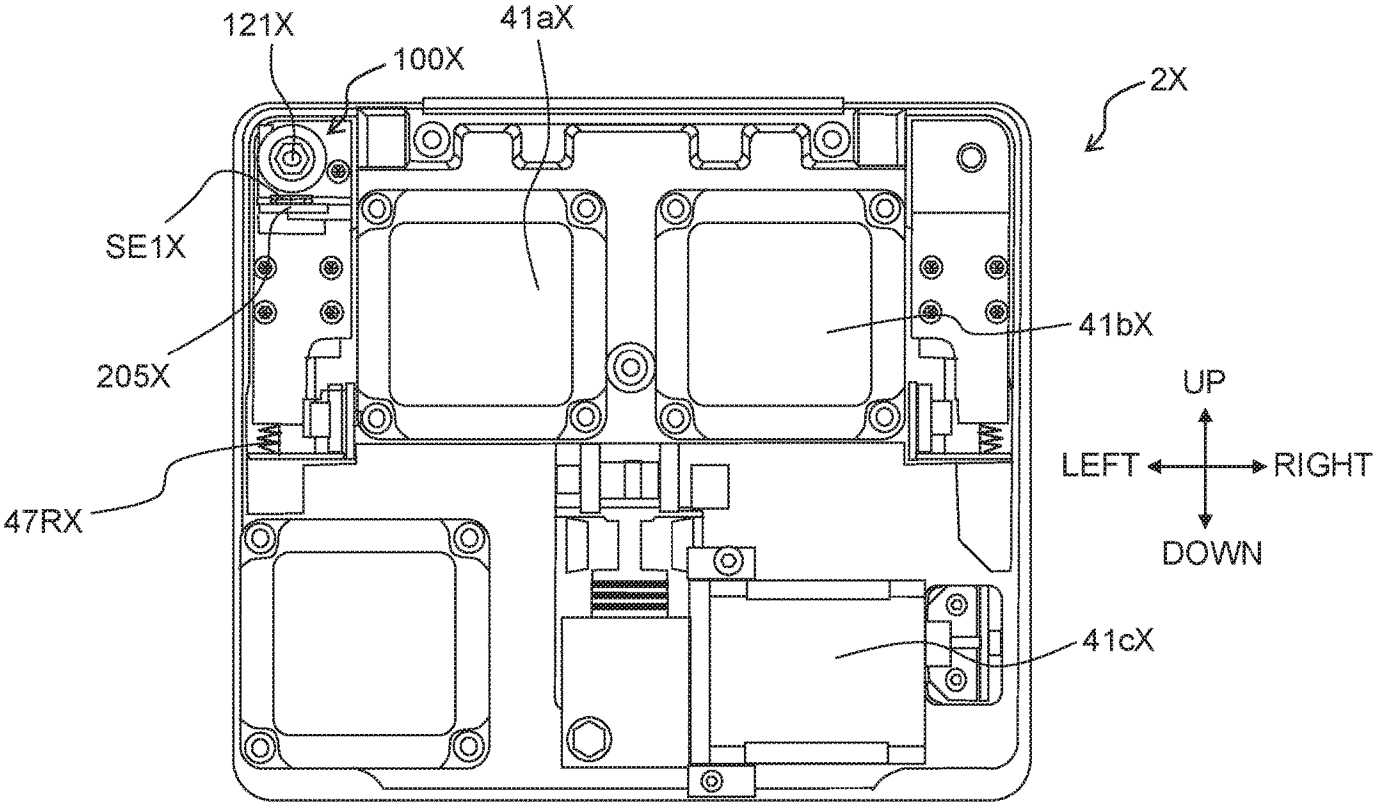
FIG. 22 is a rear view when the printing apparatus is seen from a rear side.

An overall structure of a printer 2X according to this modified example is depicted in FIG. 19 to FIG. 21. In FIG. 19 to FIG. 21, a casing corresponding to the casing 21 is omitted for clarifying an arrangement. As depicted in the diagrams, the printer 2X includes a substantially rectangular base 43X corresponding to the base 43, two roll shafts 33LX and 33RX corresponding to the roll shafts 33L and 33R respectively, and four guide rollers 100X, 101X, 102X, and 103X (the guide roller 102X is omitted in the diagram) corresponding to the guide rollers 100, 101, 102, and 103 respectively.

The ink ribbon R is wound to form a roll on one (the roll shaft 33LX in this example) of the two roll shafts 33LX and 3RX, similarly as the abovementioned feed-side roll RL in FIG. 9. The roll shaft 33LX is rotationally driven by a drive motor 41*a*X corresponding to the drive motor 41*a*. Accordingly, the ink ribbon R that was wound up at the time of carrying out printing, is drawn. Moreover, the other (the roll shaft 33RX in this example) of the two roll shafts 33LX and 33RX is rotationally driven by a drive motor 41*b*X corresponding to the drive motor 41*b*. Accordingly, the ink ribbon R having an ink transferred by a thermal head 42X corresponding to the thermal head 42 after being drawn, is wound to form a roll around the roll shaft 33RX similarly as the abovementioned take-up side roll RR in FIG. 9.

The guide rollers 100X, 101X, 102X, and 103X protrude horizontally toward a front side from corner portions respectively, of the base 43X. The guide rollers 100X and 101X, similarly as the guide rollers 100 and 101, abut with the ink ribbon R drawn from a roll on the roll shaft 33LX. Accordingly, the guide rollers 100X and 101X guide the ink ribbon R to the thermal head 42X along a predetermined transportation path. The guide rollers 102X and 103X, similarly as the guide rollers 102 and 103, abut with the ink ribbon R after being used as described above. Accordingly, the guide rollers 102X and 103X guide the ink ribbon R which is directed toward a roll on the roll shaft 33RX.

<Guide Roller 100X and a Supporting Structure Thereof>

As depicted in FIG. 19 to FIG. 21, the guide roller 100X includes a shaft 112X corresponding to a combined (united) body of the shaft 112 and the shaft sleeve 114, extended in the front-rear direction, two shaft bearings 116*a*X and 116*b*X corresponding to the shaft bearing 116, and a spacer 117X corresponding to the spacers 117F and 117R.

The shaft 112X includes from the front side to the rear side, a large-diameter portion 112*a*X having the largest outer diameter, a medium-diameter portion 112*b*X having an outer diameter smaller than the outer diameter of the large-diameter portion 112*a*X, and a small-diameter portion 112*c*X having an outer diameter smaller than the outer diameter of the medium-diameter portion 112*b*X (in other words, having the smallest outer diameter). The shaft bearing 116*a*X rotatably supports the medium-diameter portion 112*b*X of the shaft 112X. The shaft bearing 116*b*X rotatably supports a site on the medium-diameter portion 112*b*X of the shaft 112X, positioned at a rear side of a front surface of the base 43X. Accordingly, the shaft 112X (in other words, the entire guide roller 100X) is rotatably supported by the shaft bearings 116*a*X and 116*b*X, in a state of being extended in the front-rear direction. In such manner, in the modified example, the mechanism is such that the shaft 112X rotates, and differs from the mechanism in the embodiment in which, the shaft 112 is fixed to the cassette 3, and the shaft sleeve 114 rotates around the shaft 112.

The magnet 120X (the first magnet or the first detection target member for example) corresponding to the magnet 120 is provided to an outer peripheral side of the small-diameter portion 112*c*X. Here, the spacer 117X described above is provided to an outer peripheral side of a portion at a front side of the small-diameter portion 112*c*X (in other words, front side of the magnet 120). Moreover, a nut 121X corresponding to the screw 121 is screwed into a rear-end portion of the small-diameter portion 112*c*X from the rear side of the magnet 120X. Accordingly, the spacer 117X and the magnet 120X are pinched (clamped) between a rear end surface of the medium-diameter portion 112*b*X and a front end surface of the nut 121X. Accordingly, the spacer 117X and the magnet 120X are fixed to the shaft 121X. As a result, the magnet 120X while being positioned at a rear side (the other side in the second direction for example) of the shaft bearings 116*a*X and 116*b*X by the spacer 117X, is fixed to the shaft 112X (in other words, to the guide roller 100X), and rotates integrally with the guide roller 100X.

<Vertically Moving Movable Member>

Even in the present modified example, similarly as in the embodiment, the shaft bearings 116*a*X and 116*b*X which rotatably support the guide roller 100X are provided to be movable in the vertical direction. Therefore, in the present modified example, a movable member 200X corresponding to the movable member 200 which is movable along the vertical direction which is parallel to the base 43X is held by the base 43X. A guide receiving portion 46LX corresponding to the guide receiving portion 46L, which is a through hole in the base 43X in the front-rear direction, is formed in the base 43X.

In other words, the movable member 200X includes a base portion 200*a*X having an upper portion passing through the guide receiving portion 46LX, and a protruding portion 200*b*X provided integrally to a rear side of the base portion 200*a*X, to protrude out from the base 43X. A sliding table 202X corresponding to the sliding table 202 is fixed to a front side of the base portion 200*a*X. The sliding table 202X is engaged with a rail 203X corresponding to the rail 203, which is fixed to the base 43X, and slides on the rail 203X. Accordingly, the movable member 200X is slidable in the vertical direction by a guiding function of the sliding table 202X and the rail 203X. On the other hand, an upper-end portion of the spring member 47RX which is a compression spring corresponding to the spring member 47L, is fixed to a lower-end portion of the base member 200*a*X. A lower end portion of the spring member 47RX is fixed to the base 43X. Accordingly, an upward thrust is applied to the movable member by a bias applied by the spring member 47RX. As a result, the movable member 200X is pushed upward by the bias applied by the spring member 47RX, in a state of being guided by the sliding table 202X and the rail 203X. As described heretofore, the magnet 120X is provided to the shaft 112X of the guide roller 100X, and the shaft 112X is supported by the movable member 200X via the shaft bearings 116*a*X and 116*b*X. Consequently, the magnet 120X can be said to be provided to the movable member 200X. Particularly, in this example, as depicted in FIG. 21, the magnet 120X is provided to an end portion on one side (an upper side for example) in the vertical direction (first direction for example) of the movable member 200X (in other words, at a position in a direction of height which at an upper side of an upper end of the sliding table 202X).

<Detection of Amount of Rotation by First Sensor>

On the other hand, in this case, the base portion 200*a* of the movable member 200X supports an outer circumferential side of the shaft bearing 116*a*X (more elaborately, an outer-ring portion similar to the outer-ring portion 116*o* which is omitted in the diagram), which rotatably supports the guide roller 100X. Moreover, the protruding portion 200*b*X positioned at the rear side of the base portion 200*a*X supports an outer circumferential side of the shaft bearing 116*b*X (more elaborately, an outer-ring portion 116*o* similar to the outer ring-portion 116*o* which is omitted in the diagram), which rotatably supports the guide roller 100X.

Moreover, a mounting stage 205X corresponding to the mounting stage 205 is installed on an upper portion of the protruding portion 200*b*X. A magnetic sensor SE1X (the first sensor for example) corresponding to the magnetic sensor SE1 is provided to an upper portion of the mounting stage 205X, to be facing the magnet 120X in the vertical direction. In other words, the magnetic sensor SE1X is held by the protruding portion 200*b*X of the movable member 200X via the mounting stage 205X, and detects magnetically the rotation of the magnet 120X which rotates together with the guide roller 100X. Similarly as in the embodiment, an amount of rotation of the guider roller 100X that has been detected, is output from the magnetic sensor SE1X to a controller which not depicted in the diagram. As described above, since the guide roller 100X has the function of guiding the ink ribbon R transported, the controller is capable of detecting an amount of the ink ribbon R transported, on the basis of the amount of rotation of the guide roller 100X that has been input. On the basis of the detection result, the controller controls the drive motors 41*a*X and 41*b*X which rotationally drive the roll shafts 33LX and 33RX, and is capable of adjusting an actual speed of transporting the ink ribbon R, to an appropriate value. More specifically, similarly as in the embodiment, the diameter of the ink ribbon R is calculated from the input pulse from the encoder and the rotational speed of the drive motors 41*a*X, and 41*b*X, and it is possible to adjust the speed of transporting the ink ribbon R by adjusting the rotational speed of the drive motors 41*a*X and 41*b*X, to an appropriate value. The detailed structure of the magnet 120X being similar to that of the magnet 120, the description thereof is omitted. Moreover, for detecting the amount of rotation of the guide roller 100X, a known optical detection method in which an optical encoder is used, or another known method of non-contact detection may be used, similarly as in the embodiment.

<Vertical-Movement Detection by Second Sensor>

On the other hand, as depicted in FIG. 20 and FIG. 21, a magnet 220X (the second magnet or the second detection target member for example) corresponding to the magnet 220 is fixed to a lower side of the base portion 200*a* of the movable member 200X. Particularly, in this example, the magnet 220X is provided to an end portion (in other words, in this example, a position in a direction of height at a lower side of a lower end of the sliding table 202X) on the other side (the lower side for example) in the vertical direction (the first direction for example), of the movable member 200X.

Moreover, a magnetic sensor SE2X (the second sensor for example) corresponding to the magnetic sensor SE2 is provided to the base 43X, to be facing the magnet 220X in the leftward-rearward direction. Here, as described above, for the guide roller 100X, the shaft bearings 116*a*X and 116*b*X are held by the movable member 200X. Accordingly, the guide roller 100X, while being pushed upward by the bias applied by the spring member 47RX, is held in a state of being movable vertically, and guides by abutting with the ink ribbon R drawn from the abovementioned feed-side roll (also refer to the abovementioned arrow a in the structure depicted in FIG. 9). Accordingly, when the tension in the ink ribbon R becomes high, the guide roller 100X moves downward, resisting the bias applied by the spring member 47RX, and when the tension in the ink ribbon R becomes low, the guide roller 100X moves upward by the bias applied by the spring member 47RX.

Similarly as in the embodiment, the magnet 220X provided to the movable member 200X moves in the vertical direction in accordance with the movable member 200X moving vertically together with the guide roller 100X as aforementioned. Accordingly, a strength of the magnetic field generated by the magnet 220X at a position of the magnetic sensor SE2X changes. The magnetic sensor SE2X, on the basis of the changing magnetic field strength, detects a position of the magnet 220X (in other words, a position of the movable member 200X and a position of the guide member 100X). The position of the guide roller 100X that has been detected is output from the magnetic sensor SE2X to the controller which is not depicted in the diagram. As described above, the position of the guide roller 100X that moves vertically, corresponds to the magnitude of the tension in the ink ribbon R transported. Therefore, the controller is capable of detecting the tension in the ink ribbon R on the basis of the position in the vertical direction of the guide roller 100X that has been input. Accordingly, on the basis of the detection result, the controller is capable of adjusting the actual tension in the ink ribbon R by a known appropriate method (including the control of the drive motors 41*a*X and 41*b*X described above). The method for detecting the position of the guide roller 100X, similarly as described above, is not restricted to a method of magnetic detection by the magnetic sensor SE2X and the magnet 220X, and a known optical detection method in which an optical encoder is used, or another known method of non-contact detection, may be used.

In the description above, the magnetic sensor SE2X is provided to the base 43X on the fixed side, and the magnet 200X is provided to the movable member 200X on the movable side. However, the present teaching is not restricted to such arrangement. Conversely, the magnet 220X may be provided to the base 43X on the fixed side, the magnetic sensor SE2X may be provided to the movable member 200X on the movable side, and the tension in the ink ribbon R may be calculated on the basis of the an amount of relative displacement of the magnet 220X and the magnetic sensor SE2X.

<Tension Detection in Guide Roller 103X>

Although diagrams and description in detail are omitted, even in the guide roller 103X, detection and adjustment of tension in the ink ribbon R is carried out by a method similar to the method for the guide roller 100X, similarly as in the guide roller 103 of the embodiment.

In other words, the guide roller 103 is rotatably supported via an appropriate shaft bearing, and the shaft bearing is supported by a movable member (not depicted in the diagram) similar to the movable member 200X. The movable member, similar to the movable member 200X, is provided to the base 43, to be movable in the vertical direction while being guided by the sliding table and the rail, and an upward thrust is applied by a bias applied by a spring member similar to the spring member 47RX.

Here, similar to the movable member 200X, a magnet (not depicted in the diagram) similar to the magnet 220X is fixed to the movable member not depicted in the diagram, and a magnetic sensor (not depicted in the diagram) similar to the magnetic sensor SE2X is provided to the base 43X, to be facing the magnet not depicted in the diagram, in the front-rear direction. As a result, similarly as described above, when the tension in the ink ribbon R guided by the guide roller 103X becomes high, the guide roller 103X moves downward resisting the bias applied by the spring member not depicted in the diagram. Moreover, when the tension in the ink ribbon R is made low, the guide roller 103X moves upward by the bias applied by the spring member not depicted in the diagram. As a result, the magnetic strength changes in accordance with the vertical movement of the magnet not depicted in the diagram, which is provided to the guide roller 103X and the movable member not depicted in the diagram. On the basis of the change in the magnetic strength, a position of the magnet (in other words, a position of the guide roller 103X) is detected by the magnetic sensor not depicted in the diagram. The position of the guide roller 103X detected is output from the magnetic sensor to the controller, and the tension in the ink ribbon R is detected, and on the basis of the tension detected, the controller adjusts the actual tension in the ink ribbon R to an appropriate value, by a known appropriate method (including the control of the drive motors 41*a*X and 41*b*X described above).

The movable member not depicted in the diagram, the spring member not depicted in the diagram, and the shaft bearing not depicted in the diagram (not including an arrangement such as the magnet 200X and the magnetic sensor SE1X) form the second tension applying mechanism. The second tension applying mechanism adjusts the tension in the ink ribbon R provided to the ribbon path from the thermal head 42 up to the take-up side roll as described above.

<Effect of Modified Example>

Even with the printing apparatus 2X of the present modified example, an effect similar to that of the embodiment is achieved.

In other words, the guide roller 100X which guides the ink ribbon R is rotatably supported by the shaft bearings 116*a*X and 116*b*X, and the shaft bearings 116*a*X and 116*b*X are supported by the movable member 200X held by the base 43X, to be movable in the vertical direction. Accordingly, the guide roller 100X is movable in the vertical direction with respect to the base 43X, together with the movable member 200X. Moreover, since the upward bias is applied to the movable member 200X by the spring member 47RX, it is possible to adjust the tension applied to the ink ribbon R as described above.

On the other hand, in this case, the magnet 120X is provided integrally to the guide roller 100X, and rotates integrally with the guide roller 100X. Moreover, the magnetic sensor SE1X being provided to the magnet 120X, the rotation of the magnet 120X (in other words, the rotation of the guide roller 100X) is detected by the magnetic sensor SE1X. Since the outer diameter of the guide roller 100X is known, it is possible to detect the amount of the ink ribbon R transported, on the basis of the amount of rotation of the magnet 120X.

As a result, even in the present modified example, with the structure in which the movable member 200X, the spring member 47RX, the shaft bearings 116*a*X and 116*b*X, the magnet 120X, and the magnetic sensor SE1X are provided around one guide roller 100X, it is possible carry out both of the adjustment of the tension in the ink ribbon R and the detection of the amount of the ink ribbon R transported. As a result, as compared to the conventional structure in which the tension adjustment mechanism, and the sensor assembly which detects the amount of the ink ribbon R transported are provided separately as aforementioned, it is possible to reduce a space for installation, and to facilitate the small-sizing of the printing apparatus 2X.

Moreover, even in the present modified example, the printing apparatus 2X includes the magnet 220X provided to the movable member 200X, and the magnetic sensor SE2X provided to the base 43X, to be facing the magnet 220X, which detects the position of the magnet 220X. In the structure in which the guide roller 100X (together with the movable member 200X) is movable in the vertical direction with respect to the base 43X as described above, the magnet 220X is detected by the magnetic sensor SE2X which is displaced relatively with respect to the magnet 220X. Accordingly, it is possible to detect assuredly the position of the guide roller 100X in the vertical direction. As a result, it is possible to detect the tension applied to the ink ribbon R, and to carry out assuredly the tension adjustment by a drive control of the drive motors 41*a*X and 41*b*X. At this time, particularly, the magnet 220X is provided to the movable member 200X, and the magnetic sensor SE2X is provided to the base 43X. Accordingly, unlike in a case in which the magnet 220X is provided to the base 43X and the magnetic sensor SE2X is provided to the movable member 200X, it is possible to make a structure in which the magnetic sensor SE2 is not moved. Normally, the magnetic sensor SE2X is connected to the base 43X by a harness.

Moreover, even in the present modified example, the magnets 120X and 220X are detected by the magnetic sensors SE1X and SE2X. Accordingly, it is not susceptible to have an effect of disturbance due to dust unlike in a case of carrying out the detection optically.

Moreover, even in the present modified example, similarly as in the embodiment, same magnetic poles of the magnet 120X are arranged consecutively in the axial direction, and different magnetic poles of the magnet 120X are arranged alternately in the peripheral direction, and furthermore, a center position (not depicted in the diagram) in the horizontal direction of the magnetic sensor SE1X coincides with a center position (not depicted in the diagram) in the horizontal direction of the magnet 120X. Accordingly, similarly as described above, as the lines of magnetic force form a loop in the radial direction, it is not necessary to offset, and it is possible to facilitate small-sizing assuredly.

Moreover, in the present modified example, the magnet 120X is provided to an end portion of an upper side of the movable member 200X, and the magnet 220X is provided to an end portion of a lower side of the movable member 200X. Accordingly, it is possible to arrange the magnet 120X and the magnet 220X to be separated apart in the vertical direction. Consequently, a space in which the magnetic sensor SE1X is arranged does not interfere with a space in which the magnetic sensor SE2X is arranged. Moreover, by separating apart the magnet 120*x* and the magnet 220X, since a strength of a magnetic field generated by the magnet 220X at the position of the magnetic sensor SE1X and a strength of a magnetic field generated by the magnet 120X at the position of the magnetic sensor SE2X are weakened, the accuracy of detection is improved.

(2) Miscellaneous

In the description made heretofore, the reference made to terms such as 'perpendicular', 'horizontal', 'parallel', and 'flat', is not intended to be made in a strict sense. In other words, in the terms 'perpendicular', 'horizontal', 'parallel', and 'flat', tolerance and error in designing and manufacturing are acceptable, and the terms signify 'substantially perpendicular', 'substantially horizontal', 'substantially parallel, and 'substantially flat' respectively.

Moreover, in the description made heretofore, the reference made to terms such as 'same', 'equivalent', and 'different' describing visual dimension and size, is not intended to be in a strict sense. In other words, in the terms 'same', 'equivalent', and 'different', tolerance and error in designing and manufacturing are acceptable, and the terms signify 'substantially same', 'substantially equivalent' and 'substantially different' respectively.

Moreover, apart from the description made heretofore, techniques according to the embodiment and the modified examples may be used upon combining appropriately.

Although other embodiments and modified examples are not exemplified here, various modifications may be made and implemented without departing from the scope of the present disclosure.

What is claimed is:

1. A printing apparatus, comprising:

a base;

a movable member held by the base movably along a first direction parallel to the base;

a spring configured to apply a bias, to the movable member, toward one side in the first direction;

a bearing supported by the movable member;

a roller rotatably supported by the bearing, the roller extending in a second direction orthogonal to the base;

a first detection target member fixed to the roller; and a first sensor provided to the movable member, and configured to face the first detection target member.

2. The printing apparatus according to claim 1, wherein an end portion of the spring, on the other side in the first direction, is fixed to the base, and the movable member is provided to an end portion of the spring, on the one side in the first direction.

3. The printing apparatus according to claim 1, further comprising:

a cassette mounted on the base detachably along the second direction, wherein the movable member, the spring, and the first sensor are provided to the base, and the bearing, the roller, and the first detection target member are provided to the cassette movably along the first direction, and under a condition that the cassette is mounted on the base, the movable member supports the bearing.

4. The printing apparatus according to claim 1, wherein the movable member comprises:

a sensor holding portion positioned at the other side in the first direction, with respect to the first detection target member, and configured to hold the first sensor; and a bearing holding portion positioned at one side in the second direction, with respect to the sensor holding portion, the bearing holding portion protruding toward the one side in the first direction, from the sensor holding portion, and the bearing holding portion having a surface for contacting with the other side in the first direction of the bearing.

5. The printing apparatus according to claim 3, wherein under a condition that the cassette is installed on the base, the cassette is positioned at one side in the second direction with respect to the base, and the movable member comprises:

a sensor holding portion positioned at the other side in the first direction, with respect to the first detection target member, and configured to hold the first sensor;

a bearing holding portion positioned at the one side in the second direction, with respect to the sensor holding portion, the bearing holding portion protruding toward the one side in the first direction, and the bearing holding portion being in contact with the other side in the first direction of the bearing holding portion under the condition that the cassette is installed on the base; and an inclined surface positioned at the one side in the second direction with respect to the bearing holding portion, and being inclined toward the other side in the first direction as moving away toward the one side in the second direction, from the bearing holding portion.

6. The printing apparatus according to claim 4, wherein a length of the roller, from the bearing to one end on the one side in the second direction, is longer than a length of the roller, from the bearing to the other end on the other side in the second direction, and the first detection target member is arranged on the other side in the second direction, of the bearing.

7. The printing apparatus according to claim 1, further comprising:

a second detection target member provided to one of the movable member and the base; and a second sensor provided to the other of the movable member and the base, to face the second detection target member.

8. The printing apparatus according to claim 7, wherein the second detection target member is provided to the movable member, and the second sensor is provided to the base.

9. The printing apparatus according to claim 8, wherein the first sensor is provided to an end portion on the one side in the first direction of the movable member, and the second detection target member is provided to an end portion on the other side in the first direction of the movable member.

10. The printing apparatus according to claim 1, wherein the first detection target member is a permanent magnet, and the first sensor is a magnetic sensor.

11. The printing apparatus according to claim 10, wherein same poles of the permanent magnet are arranged to be consecutive in an axial direction, and different poles of the permanent magnet are arranged alternately in a circumferential direction, and a position in the second direction, of the magnetic sensor coincides with a center position in the second direction of the permanent magnet.

12. The printing apparatus according to claim 5, further comprising:

a first linear guide provided to the base, to guide the movable member in a first range parallel to the first direction; and a second linear guide provided to the cassette, to guide the roller in a second range parallel to the first direction.

13. The printing apparatus according to claim 12, wherein the first range of the first linear guide is larger than the second range of the second linear guide.

14. The printing apparatus according to claim 12, wherein a length in the first direction, of the inclined surface, is equal to or greater than a sum of a half of the first range, a half of the second range, and a radius of the roller.

15. The printing apparatus according to claim 12, further comprising:

a first stopper provided to the base, positioned at two ends of the first range, and configured to regulate the first range by making a contact with the movable member; and a second stopper provided to the cassette, positioned at two ends of the second range, and configured to regulate the second range by making a contact with the roller, wherein in a state of the roller and the second stopper in contact, the movable member and the first stopper are separated apart.

16. The printing apparatus according to claim 12, wherein the roller is detachably installed on the second linear guide.

17. The printing apparatus according to claim 1, further comprising:

a first installing portion configured to rotatably support a ribbon feeding roll from which an ink ribbon can be drawn;

a second installing portion configured to support a take-up roll to which the ink ribbon drawn from the ribbon feeding roll is wound;

a thermal head provided to an ink-ribbon path between the first installing portion and the second installing portion;

a first tension applying mechanism provided to the ink-ribbon path between the thermal head and the first installation portion, and comprising the movable member, the spring, the bearing, the roller, the first detection target member, and the first sensor; and a second tension applying mechanism provided to the ink-ribbon path between the thermal head and the second installing portion, and comprising the movable member, the spring, the bearing, and does not include the first detection target member and the first sensor.

18. The printing apparatus according to claim 5, wherein the roller comprises:

a shaft extending in the second direction, an end portion of the shaft on the other side in the second direction being attached to the cassette;

a sleeve provided to an outer circumference of the shaft rotatably with respect to the shaft; and a connecting member connected to an end portion on the other side in the second direction of the sleeve, the connecting member being rotatable, integrally with the sleeve, with respect to the shaft, the bearing rotatably supports the connecting member, at a position on the one side in the second direction of a position at which the sleeve and the connecting member are connected, and the first detection target member is fixed to the connecting member, at a position on the one side in the second direction of the bearing.

19. A main body of a printing apparatus on which a cassette is detachably installed, the main body comprising:

a base;

a movable member held by the base and movable along an orthogonal direction, the movable member being configured to support a bearing at the time of installing the cassette, the bearing being provided to a roller in the cassette, and the roller being extended in an axial direction from a cassette base of the cassette, and the axial direction being orthogonal to the orthogonal direction;

a spring configured to apply a bias in the orthogonal direction to the movable member; and a sensor provided to the movable member, and located to face a detection target member at the time of installing the cassette, and the detection target member being provided to the roller at a position on an opposite side of the cassette base, with respect to the bearing in the axial direction.

20. A cassette detachable from a main body of a printing apparatus main body, the cassette comprising:

a cassette base;

a roller extended in a normal direction of the cassette base;

a bearing provided to the roller, to be separated apart from the cassette base in the normal direction, the bearing being configured to rotatably support the roller;

a detection target member provided to the roller, at a position on an opposite side of the cassette base, with respect to the bearing in the normal direction; and a linear guide provided to the cassette base to movably guide the roller along an orthogonal direction orthogonal to the normal direction.

* * * * *